US005333849A

United States Patent [19]

Toki et al.

[11] Patent Number: 5,333,849

[45] Date of Patent: Aug. 2, 1994

[54] ROTATABLE CASSETTE TYPE FEEDING APPARATUS

[75] Inventors: Hirotaka Toki, Kashihara; Hiranaga Yamamoto, Nara; Osamu Wakuda, Yamatotakada; Hiroyuki Nagao, Nara, all of Japan

[73] Assignee: Sharp Kabushiki Kaisha, Osaka, Japan

[21] Appl. No.: 996,522

[22] Filed: Dec. 24, 1992

Related U.S. Application Data

[63] Continuation of Ser. No. 872,772, Apr. 23, 1992, abandoned.

[30] Foreign Application Priority Data

Apr. 23, 1991 [JP] Japan ..... 3-092108

[51] Int. Cl.[5] ..... B65H 3/44

[52] U.S. Cl. ..... 271/9; 271/159; 271/164

[58] Field of Search ..... 271/9, 158, 159, 162, 271/164

[56] References Cited

U.S. PATENT DOCUMENTS

| | | | |
|---|---|---|---|
| 5,002,267 | 3/1991 | Brecy | 271/9 |
| 5,052,671 | 10/1991 | Matsuo | 271/9 |
| 5,065,995 | 11/1991 | Iwamoto | 271/9 |

FOREIGN PATENT DOCUMENTS

| | | |
|---|---|---|
| 0398659 | 11/1990 | European Pat. Off. . |
| 3150190A1 | 6/1983 | Fed. Rep. of Germany . |
| 0370836 | 5/1990 | France . |
| 56-59245 | 5/1981 | Japan . |
| 56-59251 | 5/1981 | Japan . |
| 56-121059 | 9/1981 | Japan . |
| 59-123859 | 7/1984 | Japan . |
| 59-124634 | 7/1984 | Japan . |
| 60-248532 | 12/1985 | Japan . |
| 60-262735 | 12/1985 | Japan . |
| 2209327 | 2/1990 | Japan . |
| 2127328 | 5/1990 | Japan . |
| 2205861 | 8/1990 | Japan . |

OTHER PUBLICATIONS

Copy of European Search Report.

*Primary Examiner*—D. Glenn Dayoan
*Assistant Examiner*—Carol Lynn Diuzbick

[57] ABSTRACT

A carriage driving mechanism moves a paper cassette forward and backward along a feeding direction. A cassette rotating mechanism rotates the paper cassette. A single carriage driving mechanism and a single cassette rotating mechanism are provided for each paper cassette and installed on a level between a cassette circular plate and a large turntable. The carriage driving mechanism includes a driving system constituted by a pulse motor, a series of gears, a pulley, a carriage, a wire wound around the pulley, and guide bars. The cassette rotating mechanism includes a pulse motor and a series of gears. The driving system of the carriage driving mechanism and the cassette rotating mechanism are mounted on the bottom surface of the carriage so as to be level, and move along with the carriage. This configuration enables a reduction in the height and size of a rotatable cassette-type feeding apparatus and an increase in copying functions.

7 Claims, 44 Drawing Sheets

No : PATTERN No

FIG. 24

| CONSTITUENT OPERATIONS OF PATTERNS | | | | SWITCHING |
|---|---|---|---|---|
| No. | BASIC PATTERN | No. | REVERSE PATTERN | |
| 1 | OPERATION 1 | 7 | REVERSE OPERATION 1 | MODE 1<br>↓ ↑<br>MODE 2 |
| 2 | REVERSE OPERATION 2<br>↓<br>OPERATION 4<br>↓<br>OPERATION 2 | 8 | OPERATION 2<br>↑<br>REVERSE OPERATION 4<br>↑<br>REVERSE OPERATION 2 | MODE 1<br>↓ ↑<br>MODE 3 |
| 3 | REVERSE OPERATION 2<br>↓<br>OPERATION 4<br>↓<br>OPERATION 3 | 9 | OPERATION 2<br>↑<br>REVERSE OPERATION 4<br>↑<br>REVERSE OPERATION 3 | MODE 1<br>↓ ↑<br>MODE 4 |
| 4 | OPERATION 1 | 10 | REVERSE OPERATION 1 | MODE 3<br>↓ ↑<br>MODE 4 |
| 5 | REVERSE OPERATION 3<br>↓<br>OPERATION 4<br>↓<br>OPERATION 3 | 11 | OPERATION 3<br>↑<br>REVERSE OPERATION 4<br>↑<br>REVERSE OPERATION 3 | MODE 2<br>↓ ↑<br>MODE 4 |
| 6 | REVERSE OPERATION 3<br>↓<br>OPERATION 4<br>↓<br>OPERATION 2 | 12 | OPERATION 3<br>↑<br>REVERSE OPERATION 4<br>↑<br>REVERSE OPERATION 2 | MODE 2<br>↓ ↑<br>MODE 3 |

ROTATABLE CASSETTE TYPE FEEDING APPARATUS

The application is a continuation of application Ser. No. 07/872,772 filed on Apr. 23, 1992, now abandoned.

FIELD OF THE INVENTION

The present invention relates to a rotatable cassette-type feeding apparatus which rotates a cassette storing paper so that, for example, the paper is supplied to a copying machine both lengthways and sideways.

BACKGROUND OF THE INVENTION

For example, a copying machine is provided with a feeding apparatus that supplies paper onto which information recorded on a document is to be copied to the main body of the copying machine. In order to produce enlarged and reduced copies as well as a copy of an original document size, a common feeding apparatus includes a plurality of paper cassettes.

Feeding of paper from the feeding apparatus is classified into two feeding modes, first and second feeding modes, based on the position of the paper with respect to the transport direction. The first feeding mode is referred to as lengthways feed in which the longitudinal direction of the paper coincides with the transport direction. In the second feeding mode as sideways feed, on the contrary, the longitudinal direction of the paper crosses the transport direction at right angles. When transport speed is considered, sideways feed is preferable to lengthways feed. Accordingly, some copying machines feed not only A4-sized paper sideways, but also transport A3-sized paper sideways.

In order to feed large-sized paper sideways, however, the sizes of a photosensitive drum, transport rollers and a transport path must be enlarged, and thereby resulting in increases in the size of the feeding apparatus and its manufacturing costs. Thus, the feeding apparatuses are usually designed such that large-sized paper including A3-sized and B4-sized paper is fed lengthways and small-sized paper including A4-sized and B5-sized paper is fed sideways.

However, when such a configuration is adopted in a copying machine with a variable magnification function capable of producing enlarged and reduced copies, the size of the machine and its manufacturing costs are increased or the user must undertake complicated processes to operate the machine. Because, for example, in the case of producing reduced copies, paper cassettes which feed A4-sized and B5-sized paper lengthways must be provided. Besides, if transport speed is taken into account, it is also necessary to have paper cassettes which feed A4-sized and B5-sized paper sideways. Hence, in order to provide various types of paper cassettes, the size of the paper feeding machine must be increased or the paper cassettes must be changed according to an occasion.

To prevent such problems, for example, a feeding apparatus disclosed in a Japanese Patent Application, No. 1-116438/1990 has a paper cassette which is rotatable for feeding paper both lengthways and sideways. As illustrated in FIG. 47, the paper cassette is provided with a rotatable cassette 51 and a screw shaft 52 installed at right angles to the transport direction F. A nut member 53 is screwed onto the screw shaft 52. One of the corners of the paper cassette 51 is connected rotatably to the nut member 53. Mounted on the bottom surface of the paper cassette 51 is a cassette supporting plate 55 on which a guide slit 55*a* extending in the transport direction F is formed. Installed on the bottom surface of the paper cassette 51 is a guide shaft 56 that protrudes downward and is inserted into the guide slit 55*a*. As the screw shaft 52 is driven and rotated by a motor 54, the nut member 53 moves along the screw shaft 52. This causes the guide shaft 56 to be moved along the guide slit 55*a*, and the paper cassette 51 to be rotated. As a result, the position of the paper with respect to the transport direction F is changed.

In such a conventional configuration, however, there is a need to provide an extra space in the vicinity of the paper feed opening of the paper cassette in order to install the screw shaft 52 for rotating the rotatable cassette 51, motor 54 and a reduction mechanism (not shown) and other components. Thus, this configuration is against demands for decreases in the sizes of office automation machines, which have arisen due to increasing land prices, more particularly increasing costs of offices per floor area.

SUMMARY OF THE INVENTION

An object of the present invention is to provide a rotatable cassette-type feeding apparatus of a reduced height and size.

It is a more specific object of the present invention to provide such a rotatable cassette-type feeding apparatus by reducing space occupied by a rotating mechanism and a moving mechanism used for a cassette for storing copy material.

In order to achieve the above object, a rotatable cassette-type feeding apparatus of the present invention includes at least the following means:

(1) storing means (for example, a paper cassette) for storing copy material and feeding the copy material from a predetermined feeding position;

(2) carrying means (for example, a large turntable), installed rotatably on a -base member, for carrying the storing means;

(3) first rotation driving means (for example, a small angle rotating mechanism and a 180-degree rotating mechanism), installed between the base member and the carrying means, for rotating the carrying means;

(4) second rotation driving means (for example, a cassette rotating mechanism), installed between the storing means and the carrying means, for rotating the storing means;

(5) moving means (for example, a carriage driving mechanism) for moving the storing means in a radial direction of rotation of the carrying means, the moving means being installed between the storing means and the carrying means and being level with the second rotation driving means;

(6) first rotation controlling means (for example, a microcomputer) which controls the first rotation driving means to align the center of the copy material with the transport center line when the copy material is fed;

(7) second rotation controlling means (for example, a microcomputer) which controls the second rotation driving means to switch the position of the copy material with respect to the transport direction and to position the leading edge of the copy material at right angles to the transport direction when it is fed from the storing means; and (8) movement controlling means (for example, a microcomputer) which controls the moving means to move the storing means to the feeding position.

The positional relation between the center of the copy material and the transport center line varies depending on the size of the copy material, even if copy material of different sizes is stored in the same storing means. According to the above-mentioned configuration, the first rotation controlling means controls the first rotation driving means to rotate the carrying means. This enables the center of the copy material to be always aligned with the transport center line when the copy material is fed, irrespective of the size of the copy material.

When the carrying means is rotated, the leading edge of the copy material does not cross the transport direction at right angles. Then, the second rotation controlling means controls the second rotation driving means to rotate the storing means. This causes a change in the position of the copy material with respect to the transport direction and the leading edge of the copy material to cross the transport direction at right angles.

As described above, after determining the position of the copy material with respect to the transport center line, the movement controlling means controls the moving means to move the storing means to the predetermined feeding position.

Thus, the rotatable cassette-type feeding apparatus can handle copy material of various sizes. Furthermore, since the second rotation driving means and the moving means are installed on a level between the storing means and the carrying means, the space occupied by the rotatable cassette-type feeding apparatus is decreased. This enables a reduction in the height and size of the apparatus. In addition, the installation of the first rotation driving means between the base member and the carrying means prevents interference between a mechanism for driving the storing means and a mechanism for driving the carrying means, and maximizes the rotatable cassette-type feeding apparatus's functions.

For a fuller understanding of the nature and advantages of the invention, reference should be made to the ensuing detailed description taken in conjunction with the accompanying drawings.

BRIEF EXPLANATION OF THE DRAWINGS

FIG. 24 is an explanatory view illustrating operations constituting the mode switching patterns shown in FIG. 23, controlled by a microcomputer shown in FIG. 18.

DESCRIPTION OF THE EMBODIMENTS

With reference to FIGS. 1 through 46, the following will describe one embodiment of the present invention.

Figure 3:
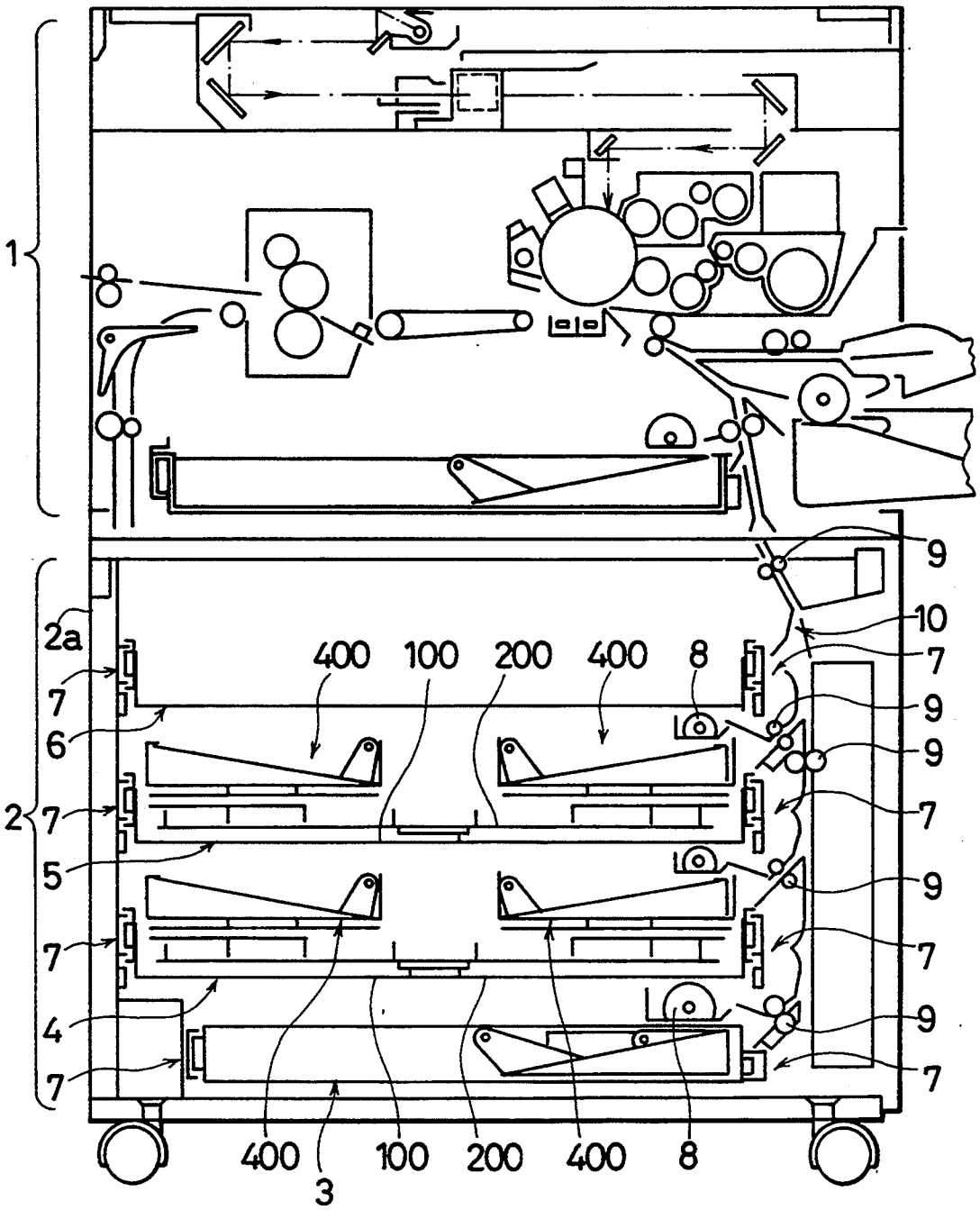
FIG. 3 is a front view illustrating the structure of a copying machine including a multi-stage feeding device having the rotatable cassette unit shown in FIG. 1.

As illustrated in FIG. 3, a copying machine is composed of a main body 1 and a multi-stage feeding device 2 located under the main body 1. The multi-stage feeding device 2 includes, from the bottom upward, a stationary cassette unit 3, rotatable cassette units 4 and 5 relating to the present invention, and a tray unit 6 for receiving paper discharged from the main body 1. A sliding mechanism 7 is installed on each side of the respective units 3 to 6 and on the corresponding internal walls of the housing 2*a* of the multi-stage feeding device 2. The sliding mechanisms 7 enable the units 3 to 6 to be pulled out of the multi-stage feeding device 2 from the front of the copying machine.

Sheets of paper stored in the stationary cassette unit 3 and rotatable cassette units 4 and 5 are supplied via a paper transport path 10 to the main body 1 by a common feeding system using paper feeding rollers 8 and transport rollers 9. Besides, the rotatable cassette units 4 and 5 are respectively provided with two types of rotatable cassettes, to be described later, which are rotated in a plane. This configuration enables the multi-stage feeding device 2 to feed an increased number and types of paper sheets, including lengthways and sideways feed and paper sizes, without expanding its floor area.

Figure 1:
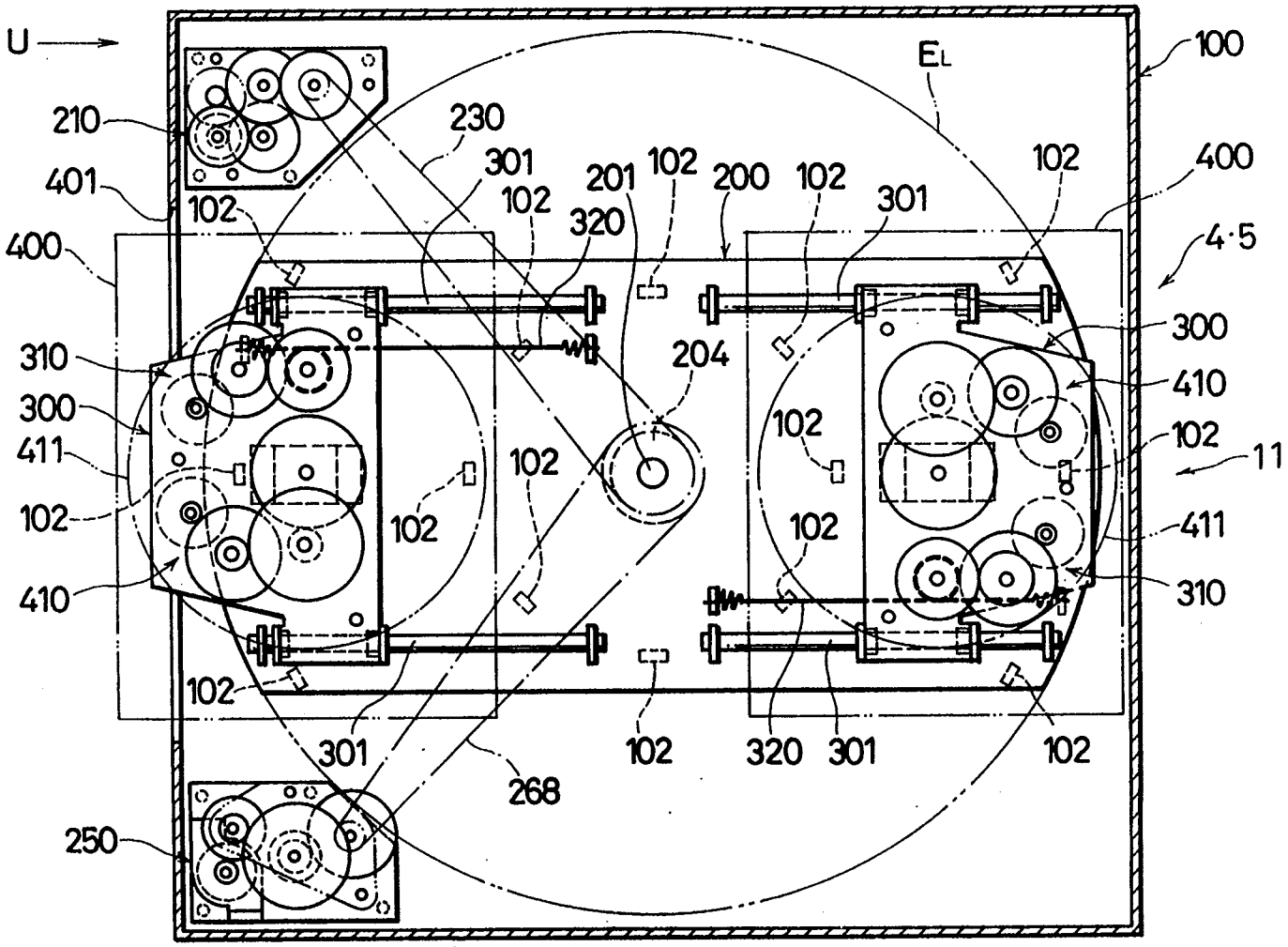
FIG. 1 is a plan view illustrating a rotatable cassette unit according to an embodiment of the present invention.
Figure 2:
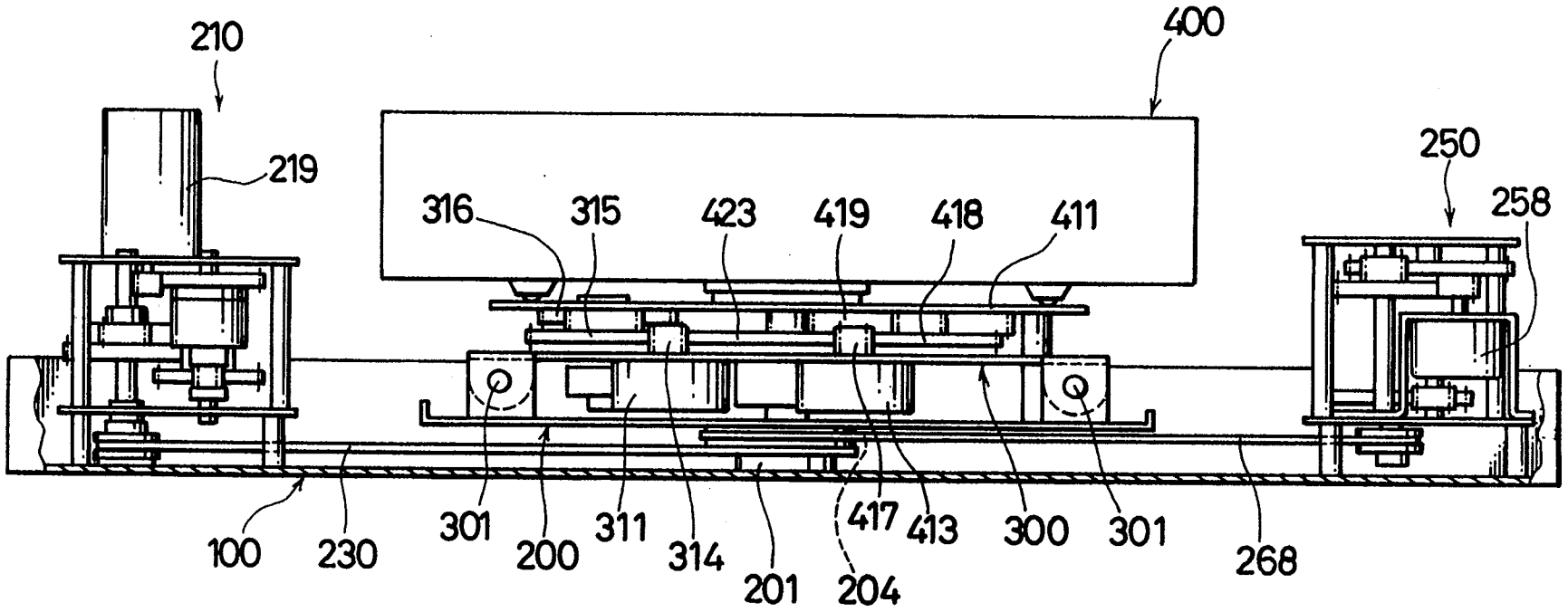
FIG. 2 is a view illustrating the rotatable cassette unit from the U side shown in FIG. 1.

As illustrated in FIGS. 1 and 2, each of the rotatable cassette units 4 and 5 has a tray 100 as a base member and a large turntable 200-serving as a cassette carrying member. The turntable 200 is mounted rotatably on the center of the floor of the tray 100 so that the bottom surface of the turntable 200 is parallel with that of the tray 100. Two carriages 300 are installed on each side symmetrically with respect to the center of the turntable 200 so that they can slide straight in a longitudinal direction of the turntable 200. A paper cassette 400 is mounted rotatably on each carriage 300 so that the bottom surface of the paper cassette 400 is parallel with the tray 100.

In this embodiment, a centering system is adopted in the rotatable cassette units 4 and 5. With this system, when feeding paper, the center of paper (hereinafter referred to as paper center $S_P$) stored in the paper cassette 400 is aligned with the feeding mechanism for feeding paper from the paper cassette 400, i.e., the center line of the transport path (hereinafter called feeding center line $SL_S$).

Figure 11:
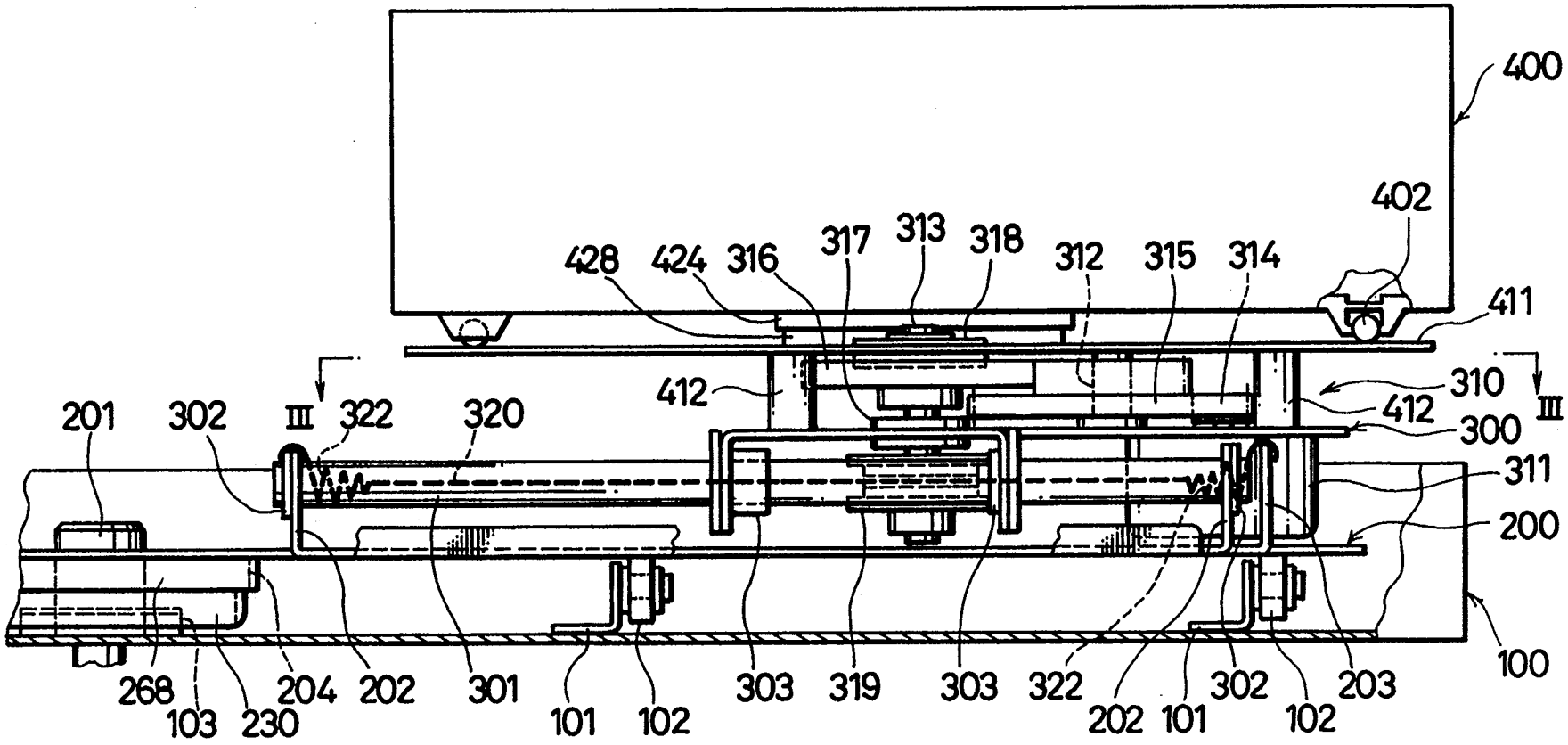
FIG. 11 is a front view of the cassette rotating mechanism shogun in FIG. 1.
Figure 15:
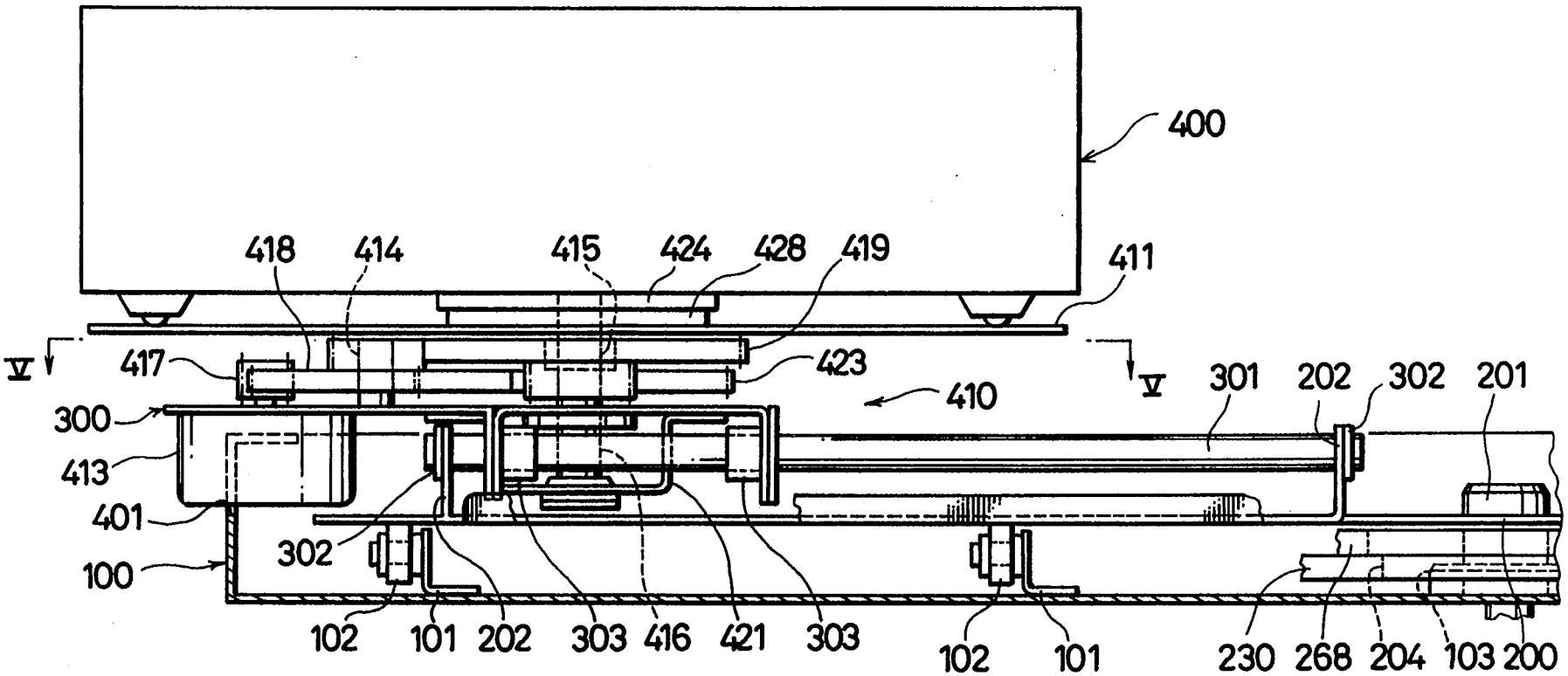
FIG. 15 is a front view of the cassette rotating mechanism shown in FIG. 1.

The turntable 200 is rotated around a rotation shaft 201, and its circumferential edges in the longitudinal direction are formed in arcs around the rotation shaft 201. As illustrated in FIGS. 11 and 15, the-normal load applied to the turntable 200 by the paper cassettes 400 storing paper is borne by fourteen supporting rollers 102 and a thrust bearing 103. The supporting rollers 102 are attached to supporting members 101 on the floor of the tray 100.

A double pulley 204 for timing belts 230 and 268 is attached to the rotation shaft 201. And the thrust bearing 103 is inserted into the double pulley 204. As illustrated in FIG. 1, eight of the supporting rollers 102 are installed on an inner portion of, i.e., around the turntable 200 at intervals of 45 degrees and six are on the circumferential edges thereof at intervals of 30 degrees.

The turntable 200 is rotated by a 180-degree rotating mechanism 210 for driving the timing belt 230 and by a small angle rotating mechanism 250 for rotating the timing belt 268. The 180-degree rotating mechanism 210 and small angle rotating mechanism 250 are respectively disposed at the corners of the tray 100 on a non-feeding side, outside of the turning space $E_L$ of the turntable 200 shown by the large circle of the alternate long and two short dashes line in FIG. 1. The non-feeding side is located opposite to a feeding side 11.

Figure 4:
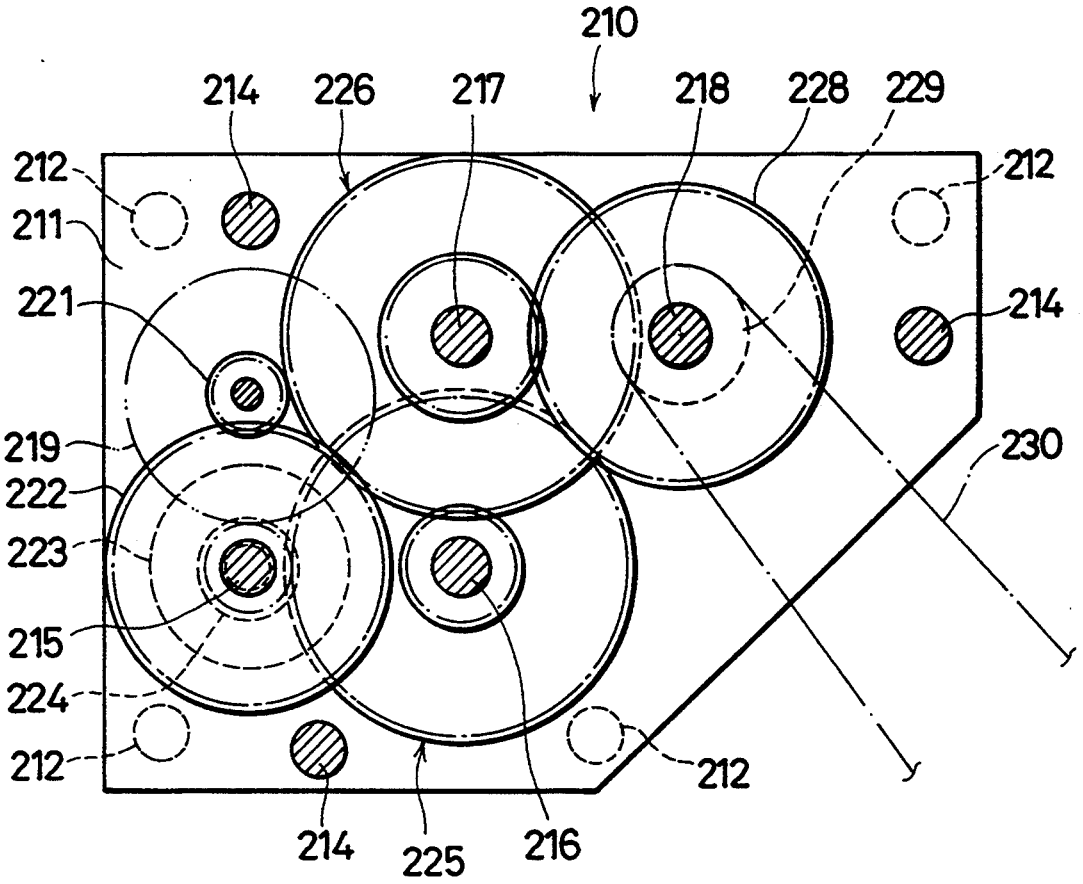
FIG. 4 is a cross section of a 180-degree rotating mechanism cut across the I—I line shown in FIG. 5.
Figure 5:
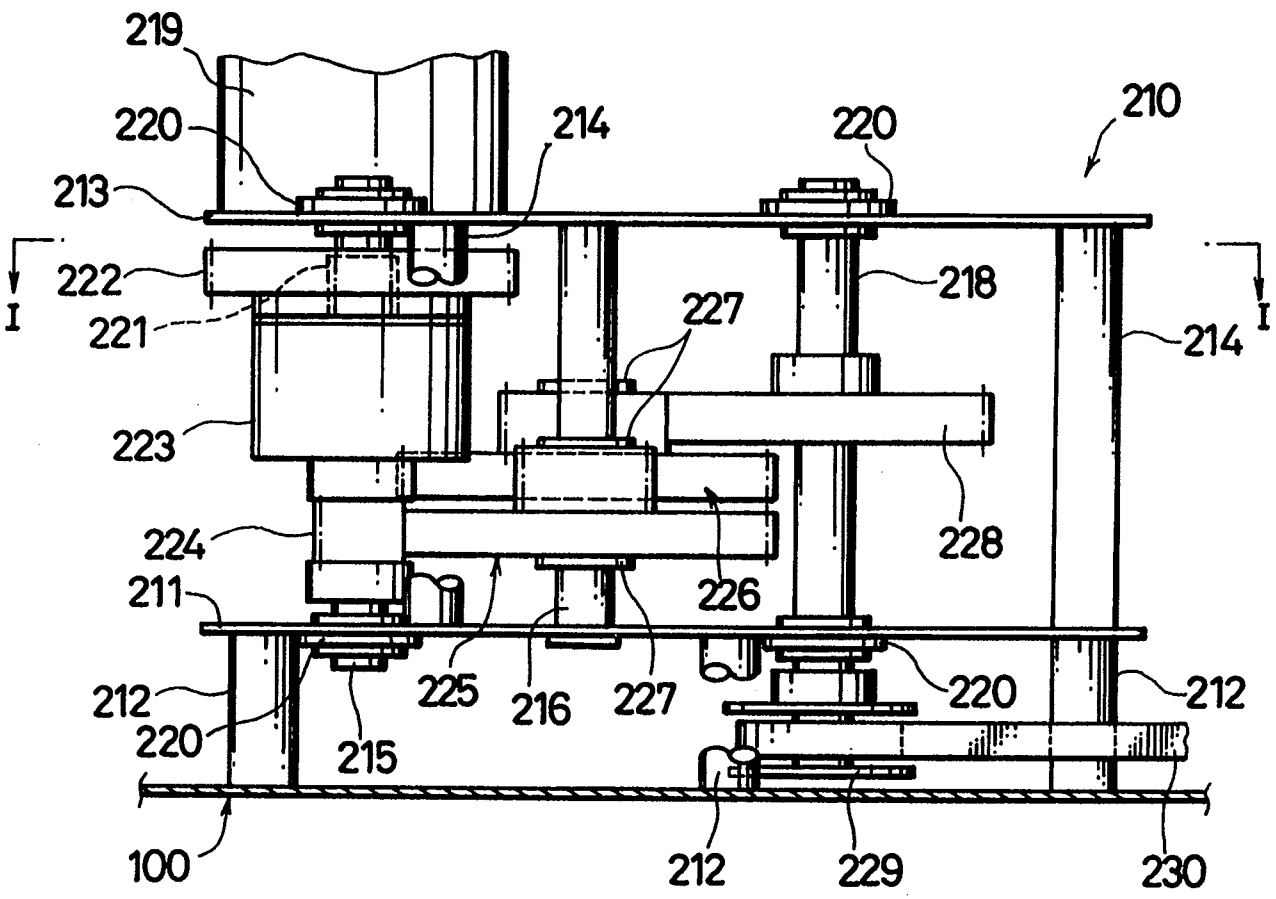
FIG. 5 is an enlarged front view of the 180-degree rotating mechanism shown in FIG. 1.
Figure 6:
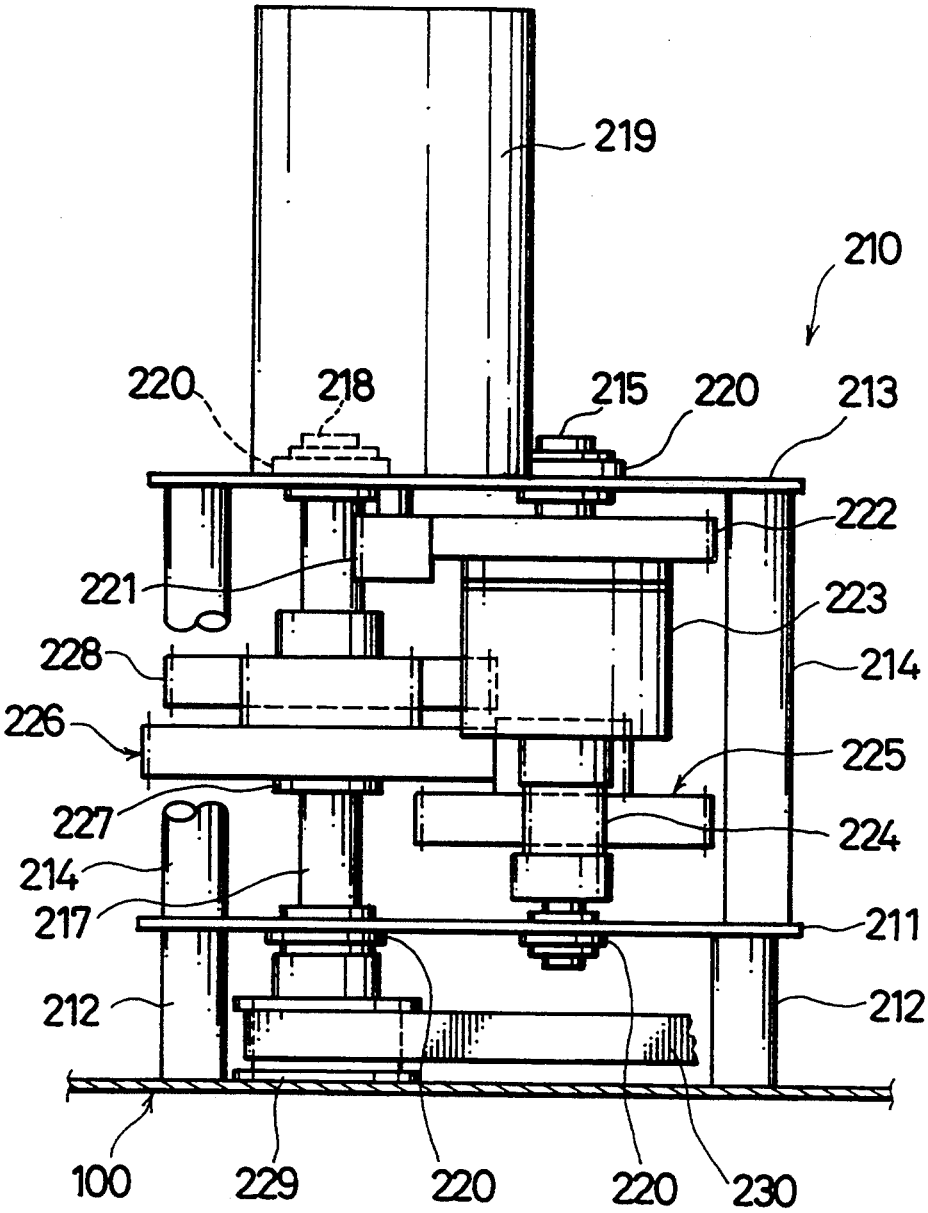
FIG. 6 is a side view of the 180-degree rotating mechanism shown in FIG. 5.

As illustrated in FIGS. 4 through 6, the lower supporting plate 211 of the 180-degree rotating mechanism 210 is supported in parallel with the tray 100 by a plurality of stays 212 mounted on the tray 100. The upper supporting plate 213 thereof is supported in parallel with the lower supporting plate 211 by a plurality of stays 214 mounted on the lower supporting plate 211. First to fourth shafts, 215 to 218, are installed between the lower supporting plate 211 and the upper supporting plate 213, and a DC motor 219 is mounted on the upper supporting plate 213. The top and bottom ends of the first shaft 215 and of the forth shaft 218 are rotatably held in oil impregnated metal powder sintered bearings 220. Meanwhile, the top and bottom ends of the second shaft 216 and of the third shaft 217 are fixed to the upper and lower supporting plates 213 and 211, respectively.

A gear 222 is attached rotatably to an upper portion of the first shaft 215 and engages With a motor gear 221 secured to the rotation shaft of the DC motor 219, while a gear 224 is fixed to a lower-portion thereof with screws. In addition, a clutch 223 is fixed to a portion of the first shaft 215 between the gear 222 and gear 224 with screws. The clutch 223 connects or disconnects the transmission of driving force between the gears 222 and 224.

A double gear 225 is attached rotatably to the second shaft 216 and engages with the gear 224, while a double gear 226 is attached rotatably to the third shaft 217 and engages with the double gear 225. The double gears 225 and 226 are respectively positioned by E-rings 227.

A timing pulley gear 228 is fixed to a portion of the fourth shaft 218 between the lower and upper supporting plates 211 and 213 with screws and engages with the double gear 226, while a timing pulley 229 is fixed to a portion thereof between the lower supporting plate 211 and the tray 100 with screws.

Through a timing belt 230, the timing pulley 229 is connected to the lower stage of the double pulley 204 attached to the rotation shaft 201. Accordingly, the power of the DC motor 219 is first transmitted to the timing pulley 229 via a series of power-transmission gears, including the motor gear 221, gear 222, clutch 223, gear 224, double gears 225 and 226 and timing pulley gear 228, and then to the rotation shaft 201 via the timing belt 230 and double pulley 204. As a result, the turntable 200 is rotated.

A reduction gear ratio $i_3$ of the 180-degree rotating mechanism 210 is set smaller than a reduction gear ratio $i_4$ of the small angle rotating mechanism 250. This is due to the following reasons.

(1) The 180-degree rotating mechanism 210 rotates the turntable 200 by a large angle, 180 degrees.

(2) Unlike the small angle rotating mechanism 250, the 180 degree rotating mechanism 210 performs its operation independently of the operations of carriage driving mechanisms 310 and cassette rotating mechanisms 410.

(3) To shorten the operation time, the 180-degree rotating mechanism must rotate the turntable 200 at an increased speed compared to the speed of the small angle rotating mechanism 250.

Figure 7:
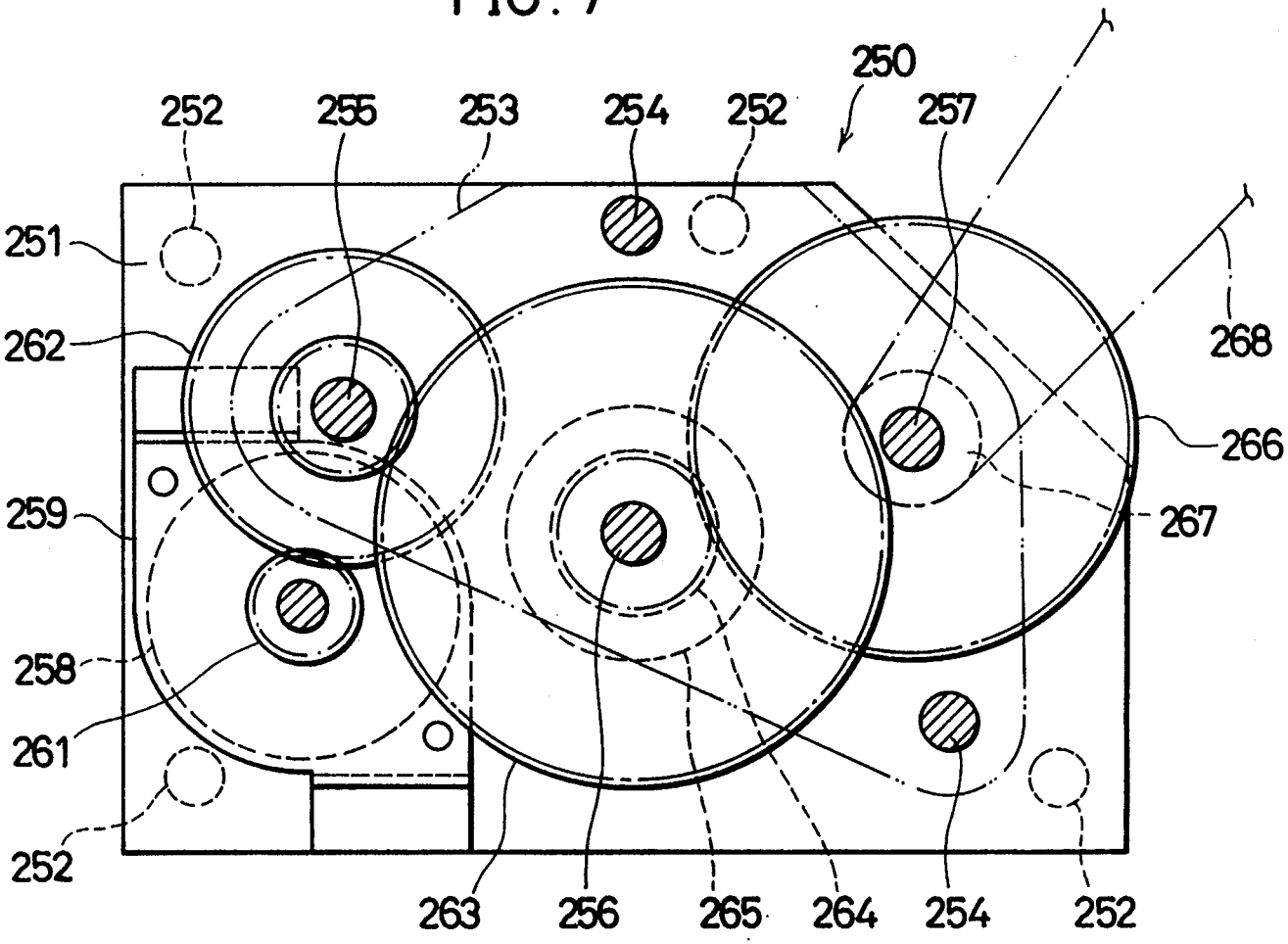
FIG. 7 is a cross section of a small angle rotating mechanism cut across the line II—II shown in FIG. 8.
Figure 8:
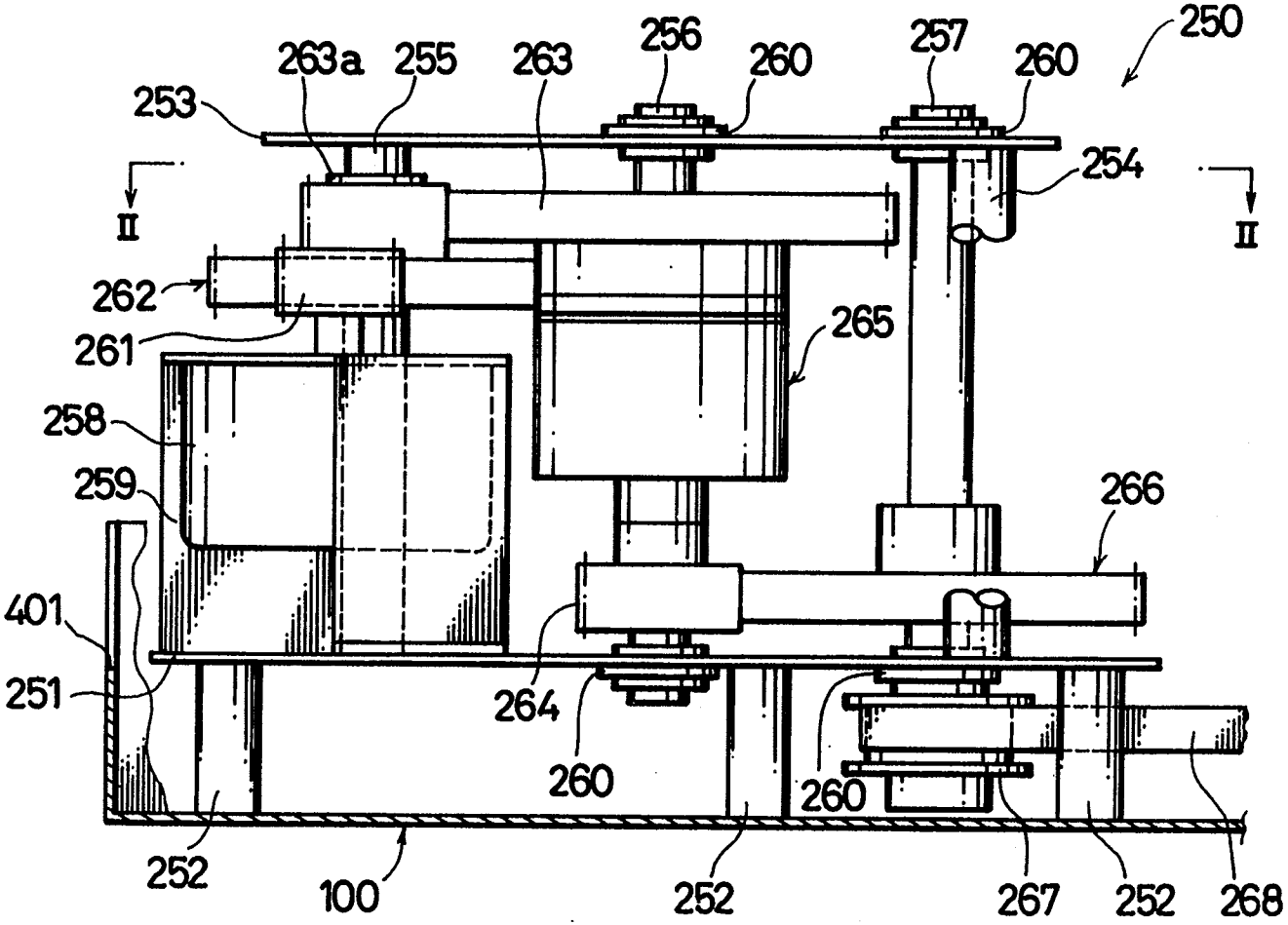
FIG. 8 is an enlarged front view of the small angle rotating mechanism shown in FIG. 1.
Figure 9:
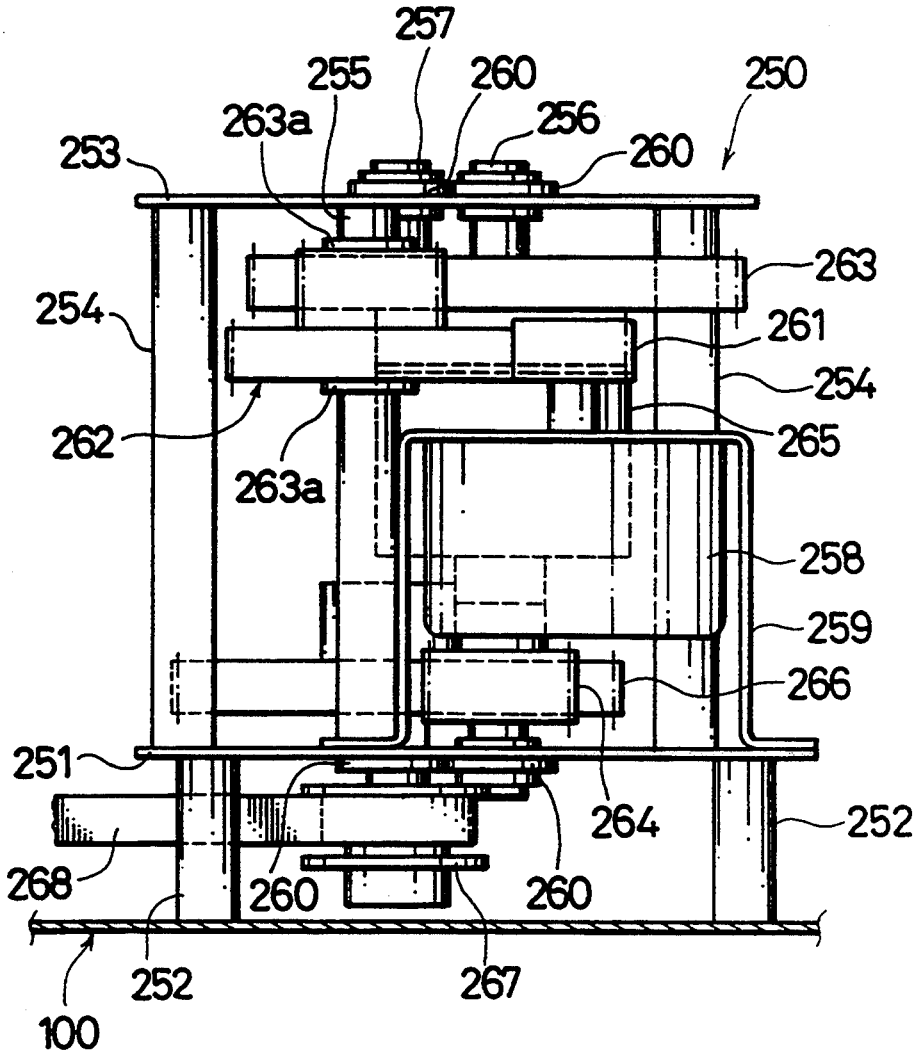
FIG. 9 is a side view of the small angle rotating mechanism shogun in FIG. 8.

Next, the following will describe the small angle rotating mechanism 250. As illustrated in FIGS. 7 through 9, the lower supporting plate 251 of the small angle rotating mechanism 250 is supported parallel with the tray 100 by a plurality of stays 252 installed on the tray 100. Meanwhile, its upper supporting plate 253 is supported parallel with the lower supporting plate 251 by a plurality of stays 254 disposed on the lower supporting plate 251. First to third shafts, 255 to 257, are installed between the lower and upper supporting plates 251 and 253, and a pulse motor 258 is mounted on the lower supporting plate 251 with a motor supporting member 259. The top and bottom ends of the second shaft 256 and of the third shaft 257 are rotatably held in oil impregnated metal powder sintered bearings 260, while the top and bottom ends of the first shaft 255 are fixed to the upper supporting plate 253 and lower supporting plate 251, respectively.

A double gear 262 is positioned by an E-ring **263*a* and attached rotatably to the first shaft 255, and engages with a motor gear 261 attached to the rotation shaft of the pulse motor 258. A gear 263 is attached rotatably to an upper portion of the second shaft 256 and engages with the double gear 262, while a gear 264 is fixed to a lower portion thereof with screws. In addition, a clutch 265 is fixed to a portion of the second shaft 256 between the gears 263 and 264 with screws. The clutch 265 connects and disconnects the transmission of driving force between the gears 263 and 264**.

A timing pulley gear 266 is fixed to a portion of the third shaft 257 between the lower and upper supporting plates 251 and 253 with screws and engages with the gear 264. Besides, a timing pulley 267 is fixed to a portion thereof between the lower supporting plate 251 and the tray 100 with screws.

Through a timing belt 268, the timing pulley 267 is connected to the upper stage of the double pulley 204. Accordingly, the power of the pulse motor 258 is first transmitted to the timing pulley 267 via a series of power-transmission gears, including the motor gear 261, double gear 262, gear 263, clutch 265, gear 264 and timing pulley gear 266, and then to the rotation shaft 201 via the timing belt 268 and double pulley 204 at the reduction gear ratio $i_4$. As a result, the turntable 200 is rotated.

As illustrated in FIG. 1, a pair of slide supporting bars 301 are provided for each carriage 300. The slide supporting bars 301 are disposed horizontally in the longitudinal direction and on a level parallel with the turntable 200 in the vicinity of the longer sides of the turntable 200. Each carriage 300 is supported by and slides over the pair of slide supporting bars 301 in the longitudinal direction of the turntable 200.

Figure 10:
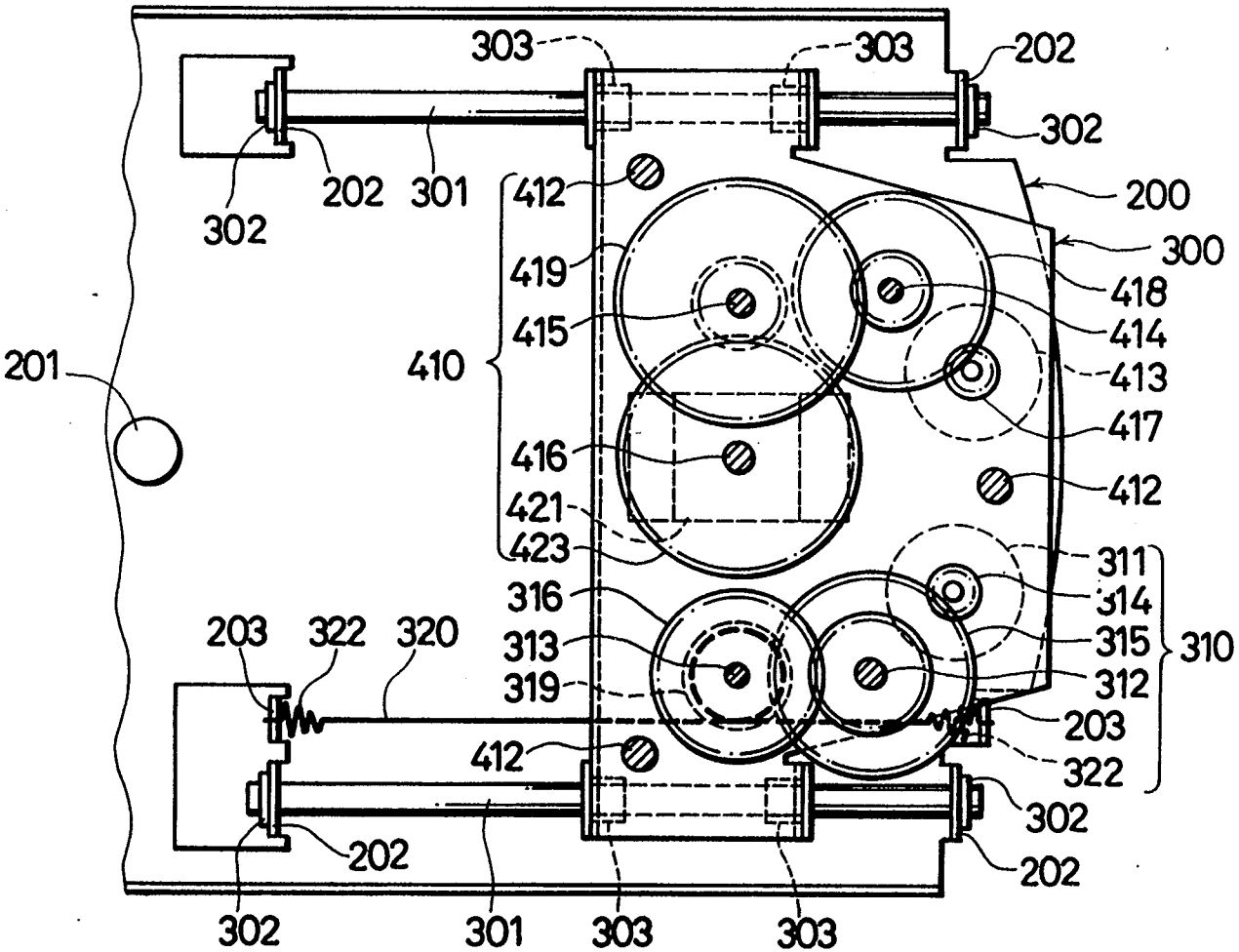
FIG. 10 is an enlarged view illustrating a carriage driving mechanism and a cassette rotating mechanism installed on one side of a large turntable shown in FIG. 1, and is also a cross sectional plan view of FIG. 11 cut across the III—III line.

As shown in FIGS. 10 and 11, both ends of each slide supporting bar 301 is fixed to a pair of bar supporting sections 202 through E-rings 302. The bar supporting section 202 is formed by cutting and raising a part of the turntable 200. Bearings 303 are mounted on the bottom surfaces of the carriages 300 so that the carriages 300 are installed slidably on the slide supporting bars 301.

Regarding the carriages 300, as shown in FIGS. 1 and 11, a carriage driving mechanism 310 as cassette moving means and a cassette rotating mechanism 410 as cassette rotating means are disposed between the turntable 200 and each of the paper cassette 400. The carriage driving mechanisms 310 drive the carriages 300 so that they slide over the slide supporting bars 301. The carriage driving mechanism 310 and cassette rotating mechanism 410 of one of the carriages 300, and the carriage driving mechanism 310 and cassette rotating mechanism 410 of the other carriage 300 are disposed symmetrically about the rotation shaft 201.

One of the significant features of the present invention is that these carriage driving mechanisms 310 and cassette rotating mechanisms 410 are substantially stored within spaces between the respective paper cassettes 400 and the turntable 200. This configuration not only enables a reduction in the size of the rotatable cassette-type feeding apparatus, but also prevents interference between these mechanisms 310 and 410 and the 180-degree rotating mechanism 210 and small angle rotating mechanism 250, more particularly interference between these mechanisms 310 and 410 and the timing belts 230 and 268 provided under the turntable 200. Another significant feature of the present invention is that, when the paper cassette 400 on the feeding side 11 and the paper cassette 400 on the non-feeding side are interchanged, the carriage driving mechanism 310 and cassette rotating mechanism 410 rotate integrally with the turntable 200.

With reference to FIGS. 10 and 11, the detail of the carriage driving mechanisms 310 will be explained below. A pulse motor 311 is mounted on the bottom surface of the carriage 300 and a fixed shaft 312 is secured to the upper surface thereof. A pulley shaft 313 passes through the carriage 300 vertically. A double gear 315 is attached rotatably to the fixed shaft 312 and engages with a motor gear 314 secured to the rotation shaft of the pulse motor 311.

Figure 12:
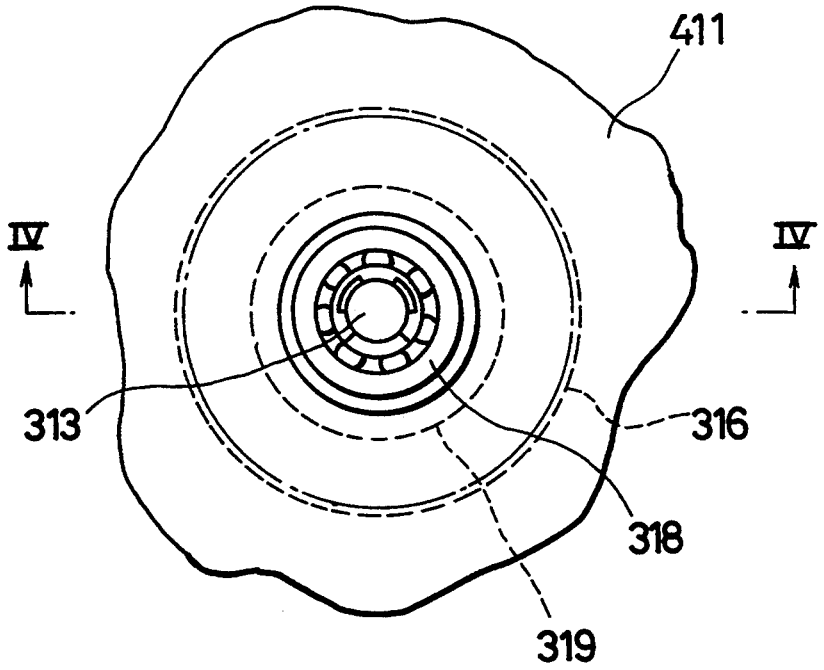
FIG. 12 is a plan view illustrating the structure of a pulley shaft shown in FIG. 10 and its periphery.
Figure 13:
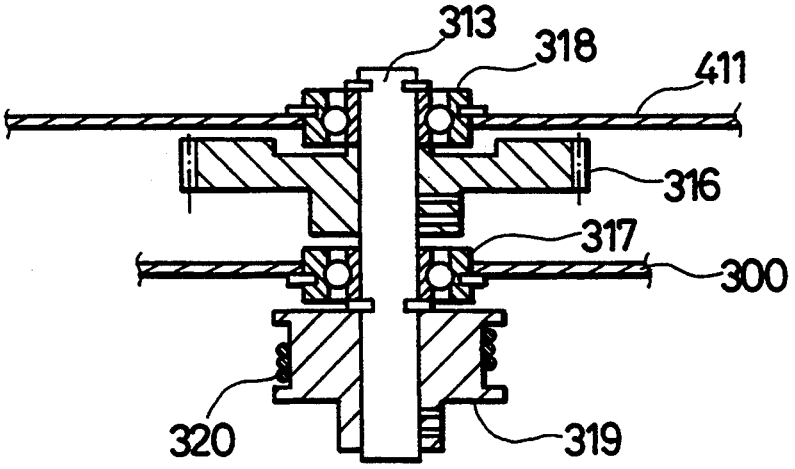
FIG. 13 is a cross section of FIG. 12 cut across the IV—IV line.

As illustrated in FIGS. 12 and 13, a near central portion and an upper portion of the pulley shaft 313 are supported via radial bearings 317 and 318 by the carriage 300 and a cassette supporting circular plate 411, respectively. Considering that the paper cassette 400 is moved by the carriage driving mechanism 310, care must be taken at the time of installation so as not to make the bottom surface of the pulse motor 311 and the lower end of the pulley shaft 313 come into contact with the turntable 200. A pulley gear 316 is fixed to a portion of the pulley shaft 313 between the radial bearings 317 and 318 with screws and engages with the double gear 315, while a wire pulley 319 is fixed to a lower portion thereof with screws. Accordingly, the power of the pulse motor 311 is transmitted to the wire pulley 319 at a reduction gear ratio $i_1$ via a series of power-transmission gears, including the motor gear 314, double gear 315 and pulley gear 316.

A wire 320 is wound around and fastened to the central portion of the wire pulley 319 with screws. As illustrated in FIG. 10, both ends of the wire 320 are connected to the wire joint sections 203 through springs 322 for preventing looseness so that the wire 320 can extend along the slide supporting bars 301. The wire joint sections 203 are formed in the vicinity of the bar supporting sections 202 by cutting and raising a part of the turntable 200.

With this arrangement, the carriages 300 are moved toward the rotation shaft 201 or the opposite direction depending on a rotation of the wire pulley 319, i.e., the normal rotation or the reverse rotation of the pulse motor 311. In relation to the movement of the carriages 300, as shown in FIGS. 1 and 15, the non-feeding side of the tray 100 is provided with a U-shaped opening 401 which permits the carriage 300 and paper cassette 400 on the non-feeding side to protrude from the tray 100.

Figure 14:
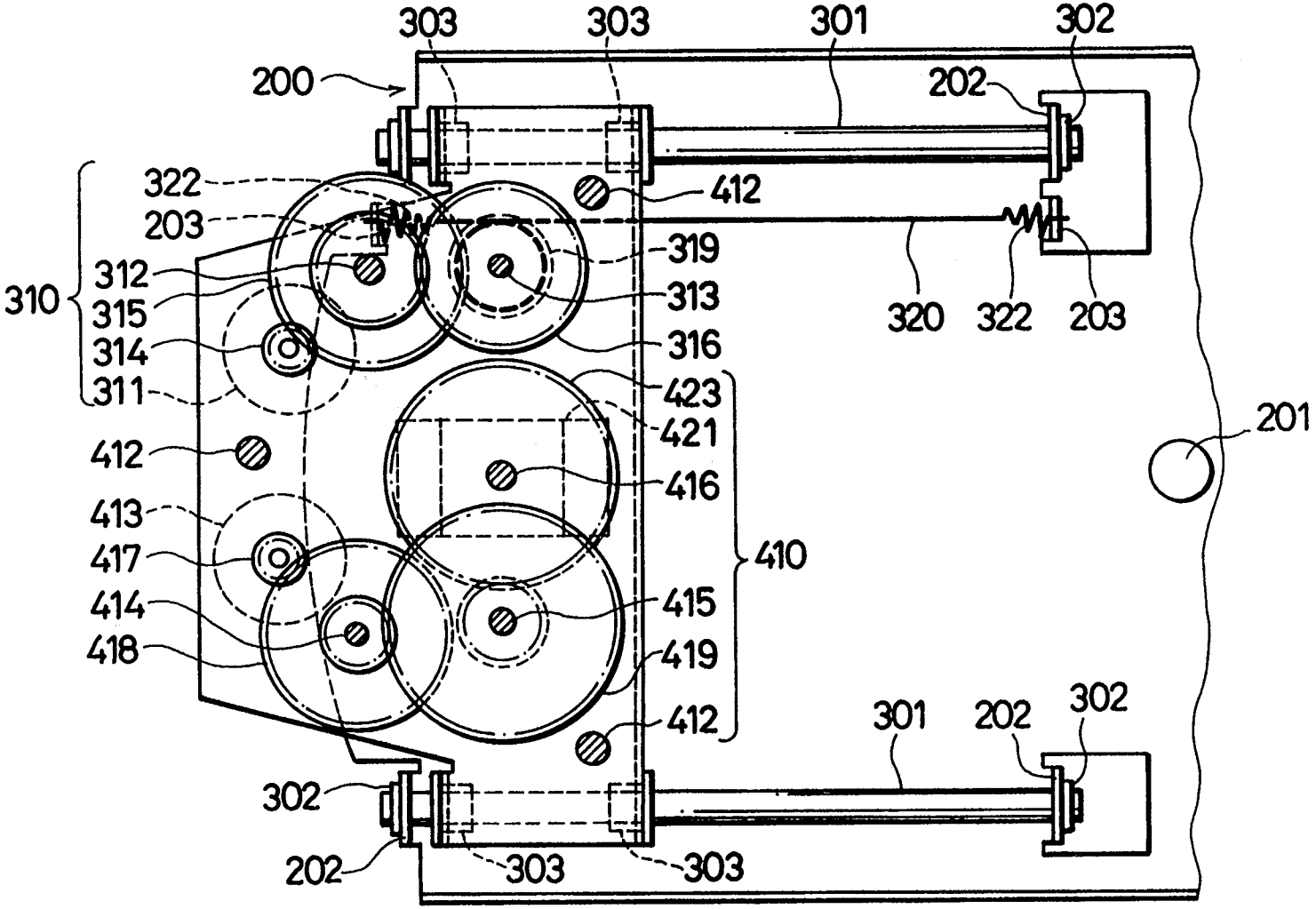
FIG. 14 is an enlarged view of a carriage driving mechanism and a cassette rotating mechanism installed on the other side of the turntable shown in FIG. 1, and is also a cross sectional plan view of FIG. 15 cut across the V—V line.

With reference to FIGS. 14 and 15, the details of the cassette rotating mechanism 410 will be explained here. The cassette supporting circular plate 411 for supporting the paper cassette 400 is mounted parallel with the carriage 300 through three spacers 412 shown in FIG. 14. A plurality of spherical casters 402 are mounted on the bottom surface of the paper cassette 400 so as to assist the rotating movement of the paper cassette 400 around a cassette rotation shaft 416. Additionally, a pulse motor 413 is mounted on the bottom surface of the carriage 300, and fixed shafts 414 and 415 are secured to the upper surface thereof. And, the cassette rotation shaft 416 passes through the carriage 300 vertically.

A double gear 418 is attached rotatably to the fixed shaft 414, and engages with a motor gear 417 around the rotation shaft of the pulse motor 413. In the meantime, a double gear 419 is attached rotatably to the fixed shaft 415, and engages with the double gear 418.

Figure 17:
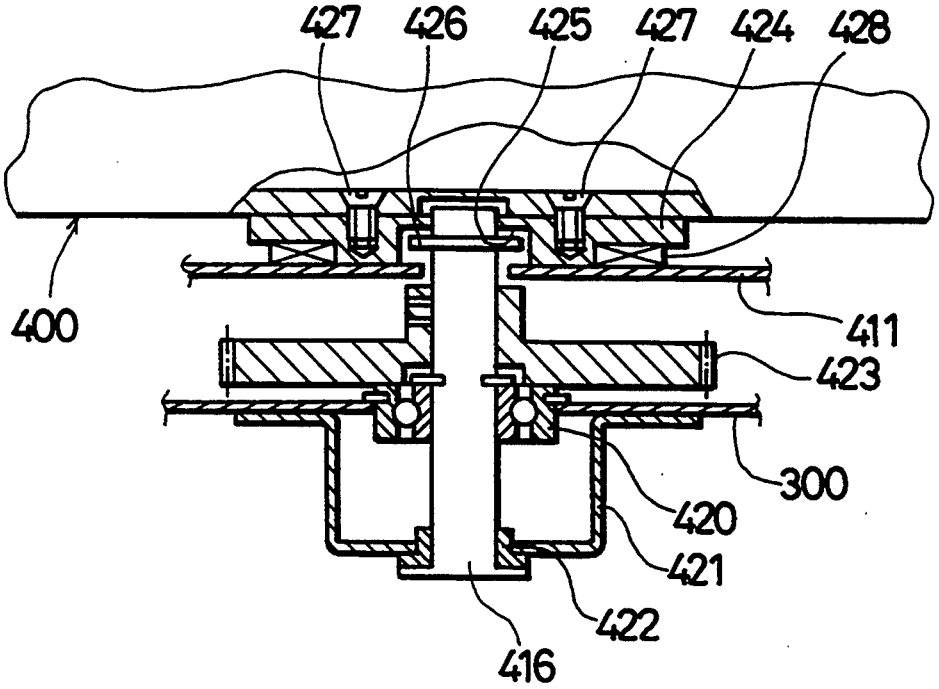
FIG. 17 is a cross section of FIG. 16 cut across the VI—VI line.

As illustrated in FIG. 17, a near central portion of the cassette rotation shaft 416 is supported through a radial bearing 420 by the carriage 300, while a lower portion thereof is supported through an oil impregnated metal powder sintered bearing 422 by a U-shaped member 421 mounted on the bottom surface of the carriage 300. A cassette gear 423 is fixed to an upper portion of the cassette rotation shaft 416 with screws, and engages with the double gear 419. Accordingly, the power of the pulse motor 413 is transmitted to the cassette rotation shaft 416 at a reduction gear ratio $i_2$ via a series of power-transmission gears, including the motor gear 417, double gears 418 and 419 and cassette gear 423.

Figure 16:
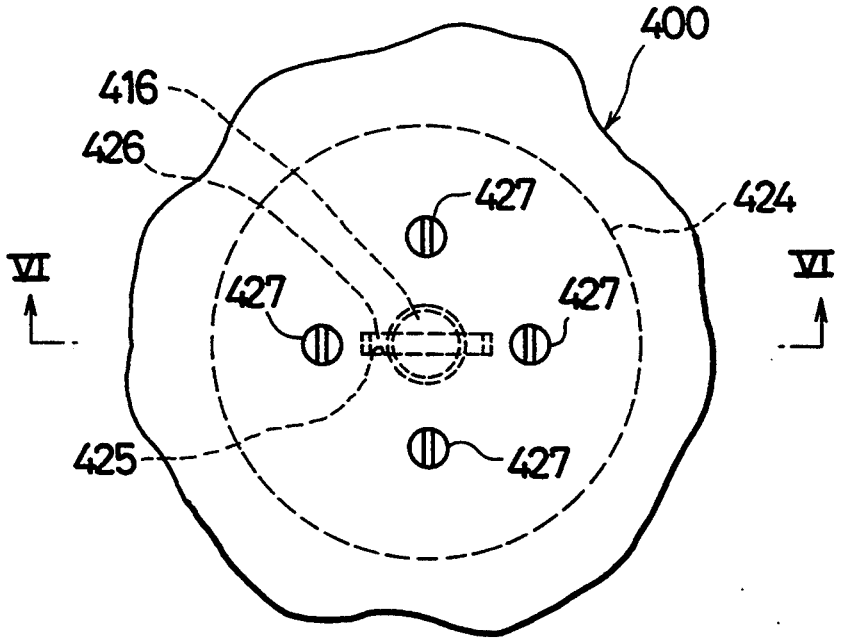
FIG. 16 is-a plan view illustrating the structure of a cassette rotation shaft shown in FIG. 15 and its periphery.

As illustrated in FIG. 16, the top end of the cassette rotation shaft-416 is inserted from an opening formed on the cassette supporting circular plate 411 into the central portion of a cassette connecting circular plate 424 installed on the bottom surface of the paper cassette 400 with screws 427. A joining socket 425 is formed on the cassette connecting circular plate 424, while a connecting pin 426 is secured to the top end of the cassette rotation shaft 416. By joining the connecting pin 426 to the joining socket 425, the cassette rotation shaft 416 is connected to the central portion of the paper cassette 400. Disposed between the cassette connecting circular plate 424 and the cassette supporting circular plate 411 is a thrust bearing 428 for supporting the paper cassette 400 rotatably. This configuration enables the paper cassette 400 to be rotated according to the normal rotation or reverse rotation of the pulse motor 413.

As described above, the installation of the carriage driving mechanisms 310 and the cassette rotating mechanisms 410 on a level in a gap between the turntable 200 and the cassette supporting circular plate 411 is one of the present invention's significant features which contributes to a reduction in the height of the rotatable cassette-type feeding apparatus. Especially, the installation of the pulse motors 311 and 413 side by side under the carriage 300 is an important feature of this embodiment.

Figure 18:
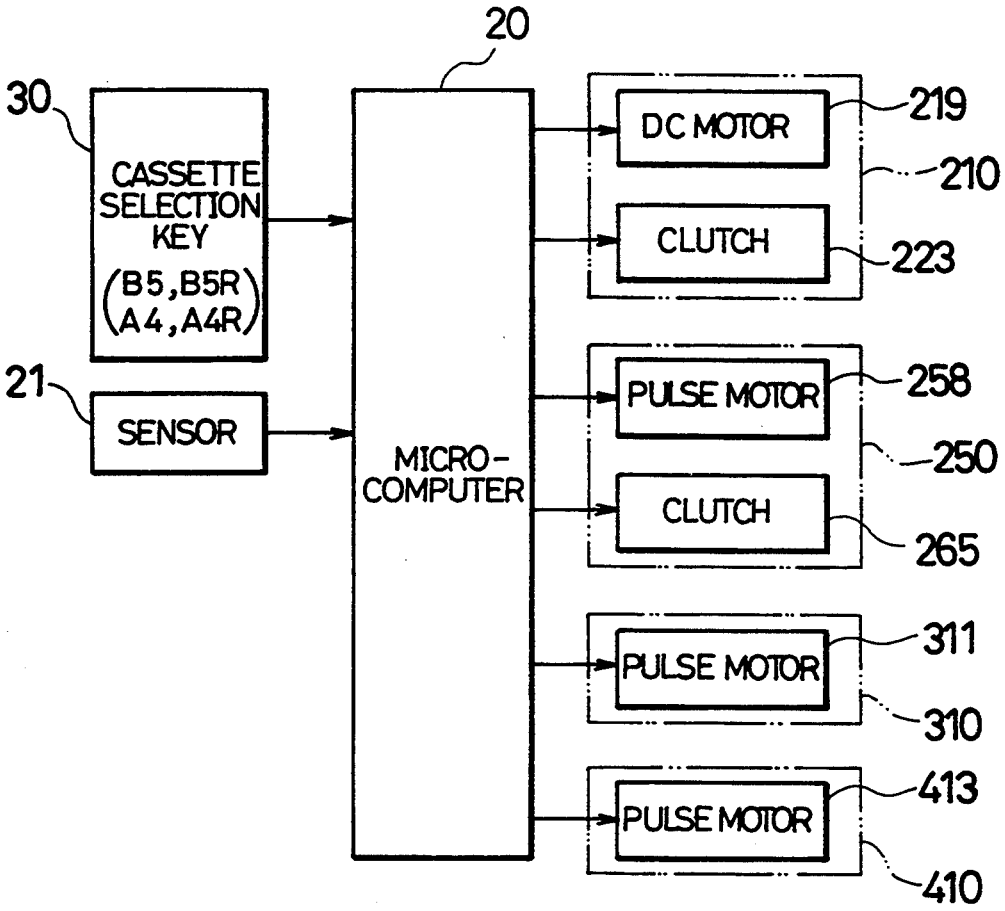
FIG. 18 is a block diagram illustrating a control system of the rotatable cassette unit shown in FIG. 1.

A microcomputer 20 as control means shown in FIG. 18 controls the following operations.

(1) Rotation of the turntable 200 around the rotation shaft 201 by the 180-degree rotating mechanism 210.

(2) Rotation of the turntable 200 by the small angle rotating mechanism 250 (hereinafter referred to as $\theta$-axis driving).

(3) Movement of the carriages 300 and paper cassettes 400 along the slide supporting bars 301, i.e. in a radial direction of the turning space $E_L$ of the turntable 200 by the carriage driving mechanism 310 (referred to as r-axis driving).

(4) Rotation of the paper cassette 400 around the cassette rotation shaft 416 by the cassette rotating mechanism 410 (referred to as $\phi$-axis driving).

Namely, the microcomputer 20 controls the $\theta$-axis driving, r-axis driving and $\phi$-axis driving simultaneously such that the paper cassette 400 storing paper of a selected size is set in a feeding position while aligning the paper center $S_P$ with the feeding center line $SL_S$. At this time, the microcomputer 20 controls the DC motor 219 and clutch 223 of the 180-degree rotating mechanism 210, the pulse motor 258 and clutch 265 of the small angle rotating mechanism 250, the pulse motor 311 of the carriage driving mechanism 310, and the pulse motor 413 of the cassette rotating mechanism 410 as described below.

Paper to be fed is selected according to:

(1) An input entered by an operator through a cassette selection key 30;

(2) The size and the position, i.e., whether it is placed lengthways or sideways, of a document which are detected by a sensor (not shown) when the document is placed on the platen of the main body 1; or (3) A specified type of copying, for example, enlarging copying and reducing copying, and the detection mentioned in (2).

In this embodiment, supposing that B5-sized paper and A4-sized paper are stored in the two paper cassettes 400 of each of the rotatable cassette units 4 and 5, B5, B5R, A4 and A4R paper are available (R such as B5R and A4R means lengthways feed).

Based on the above configuration, the following will explain the operations of the 180-degree rotating mechanism 210, small angle rotating mechanism 250, carriage driving mechanism 310 and cassette rotating mechanism 410, separately.

Figure 19:
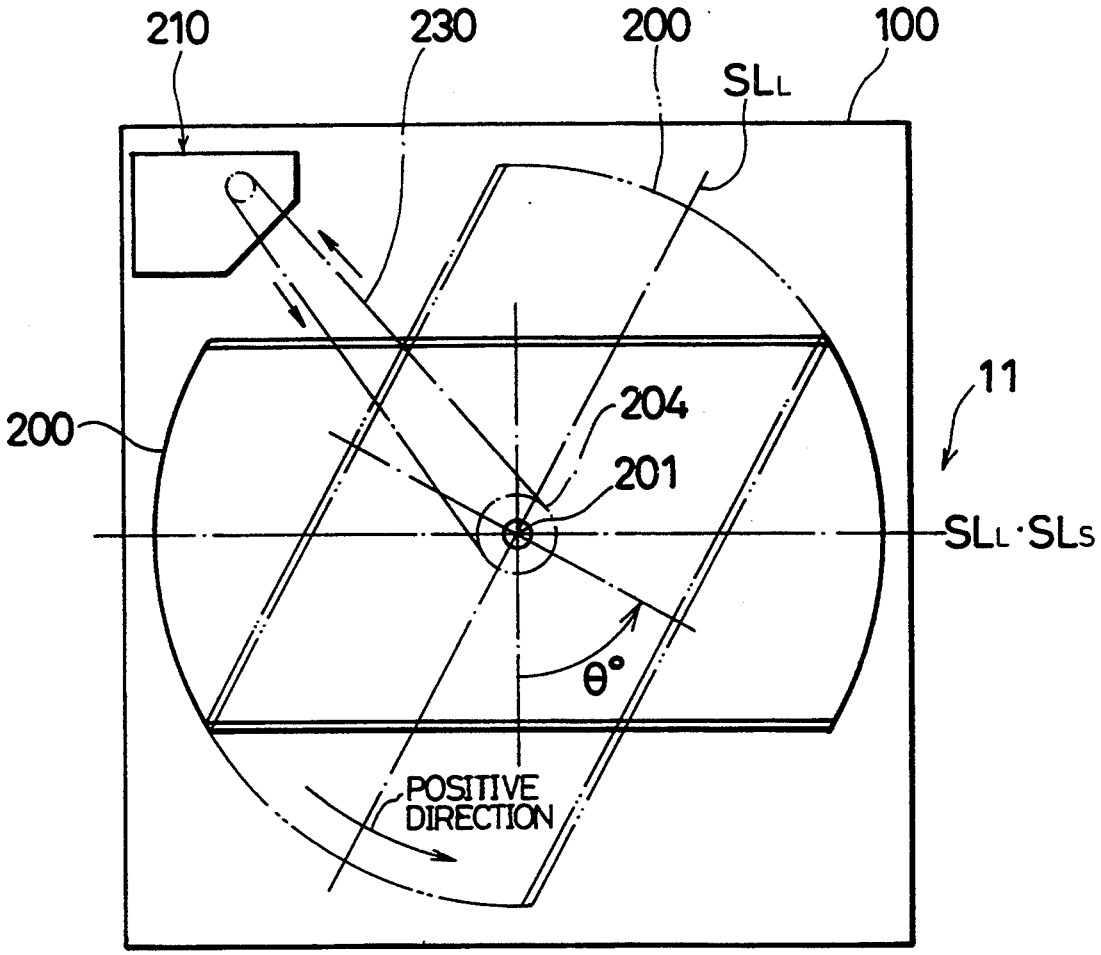
FIG. 19 is a view explaining the operation of the 180-degree rotating mechanism shown in FIGS. 4 through 6.

As illustrated in FIG. 19, the 180-degree rotating mechanism 210 turns the turntable 200 by 180 degrees so as to interchange the paper cassette 400 on the feeding side 11 and the paper cassette 400 on the non-feeding side. At this time, the power of the DC motor 219 is increased at the reduction gear ratio $i_3$ and transmitted to the rotation shaft 201 of the turntable 200 via the series of power transmission gears shown in FIGS. 4 through 6, timing belt 230 and double pulley 204.

The position of the turntable 200 after the 180-degree turn is detected by a sensor 21 shown in FIG. 18. Then, according to a detection signal from the sensor 21, the microcomputer 20 controls the DC motor 219 so as to position the turntable 200 accurately. When the 180-degree rotating mechanism 210 is actuated, the microcomputer 20 controls the clutch 223 of the series of power transmission gears to be turned ON so that the power of the DC motor 219 is transmitted. On the contrary, when the small angle rotating mechanism 250 is actuated as to be described later, it is turned OFF in order to cutoff the power transmission of the DC motor 219.

Figure 20:
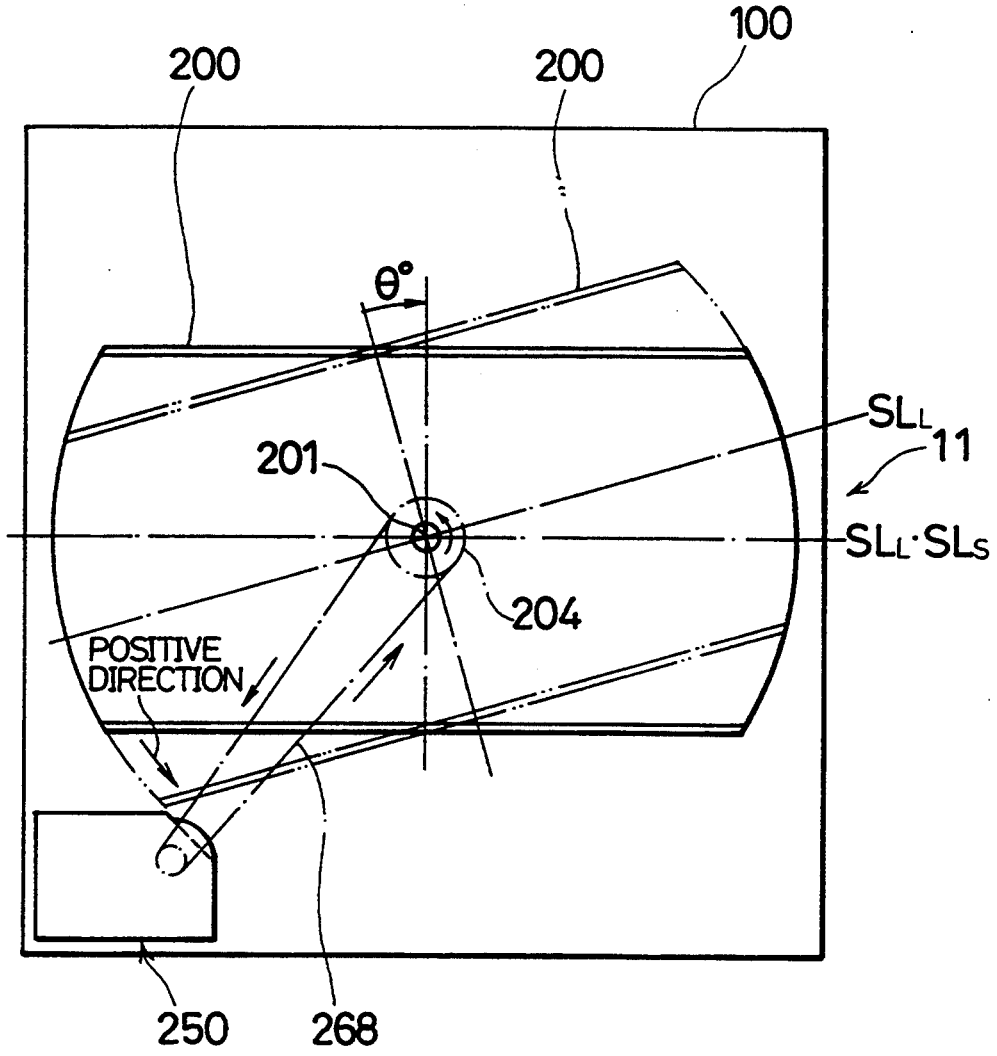
FIG. 20 is a view explaining the operation of the small angle rotating mechanism shown in FIGS. 7 through 9.

During $\theta$-axis driving by the small angle rotating mechanism 250, the power of the pulse motor 258 is increased at the reduction gear ratio $i_4$ and transmitted to the rotation shaft 201 by the series of power transmission gears shown in FIGS. 7 through 9, timing belt 268 and double pulley 204. In consequence, the turntable 200 is rotated by a small angle as illustrated in FIG. 20. This rotation is controlled by the microcomputer 20 such that the paper center Sp of the paper stored in the paper cassette 400 on the feeding side 11 aligns with the feeding center line $SL_S$ depending on lengthways feed or sideways feed. When the small angle rotating mechanism 250 is actuated, the clutch 265 of the series of transmission gears for small-angle rotation is turned ON to transmit the power of the pulse motor 258. On the other hand, when the 180-degree rotating mechanism 210 is actuated, it is turned OFF to cutoff the power transmission of the pulse motor 258.

During r-axis driving by the carriage driving mechanism 310, the power of the pulse motor 311 is increased at the reduction gear ratio $i_1$ and transmitted to the wire pulley 319 attached to the pulley shaft 313 by the series of power transmission gears shown in FIGS. 10 and 11. The microcomputer 20 controls the carriage driving mechanism 310 to drive the carriage 300 such that the paper cassette 400 on the feeding side 11 is moved to an interchanging position, sideways feed position or retracted position as to be described below.

Figure 38:
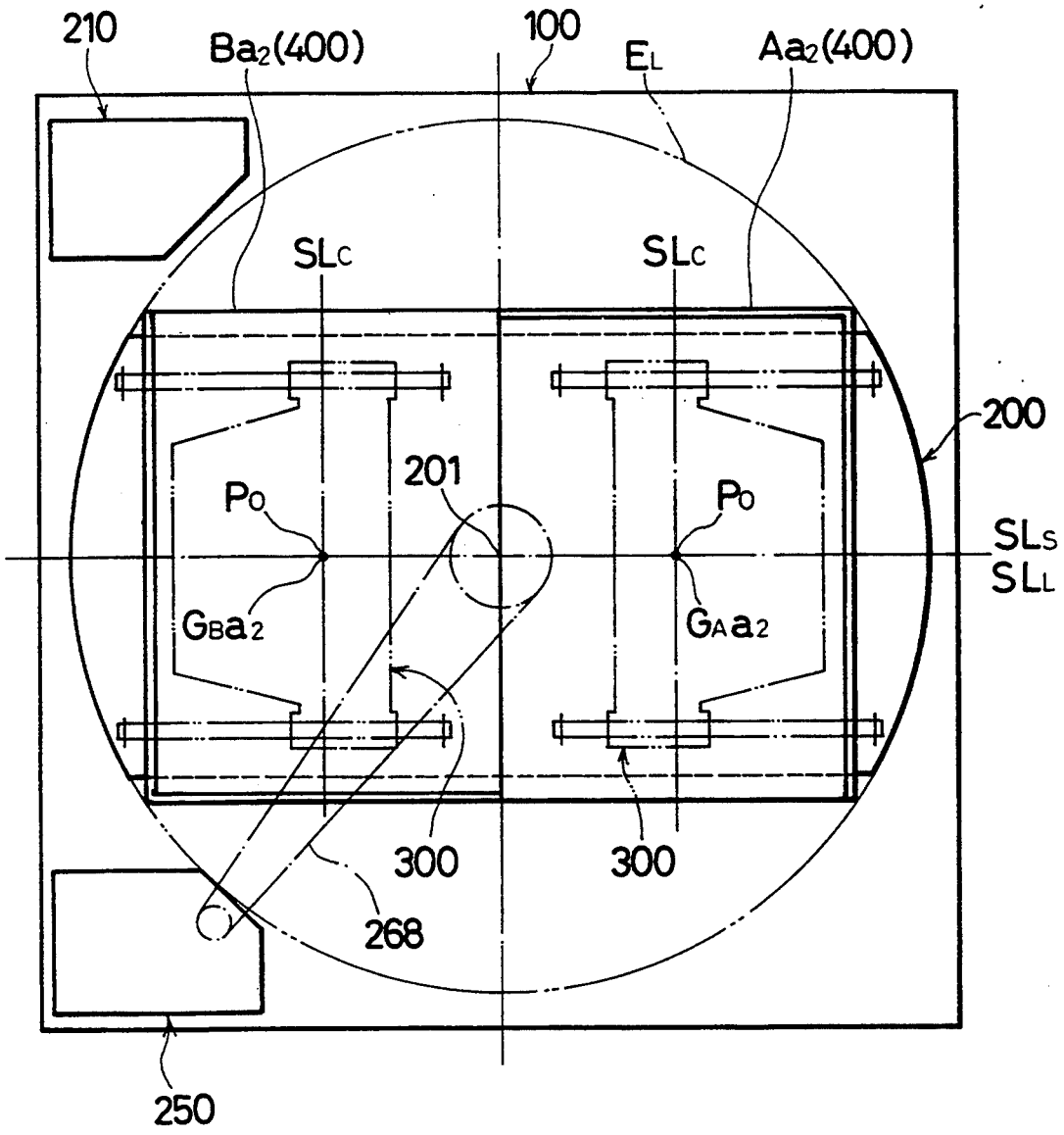
FIG. 38 is an explanatory view illustrating the states of the turntable, carriages and paper cassettes at time $a_2$ during Operation 2 shown in FIGS. 35 and 36.

As illustrated in FIG. 38, the interchanging position is a position at which the two paper cassettes 400 placed side by side come to the closest proximity of the rotation shaft 201. It is defined in this embodiment that at the interchanging position the sides of the cassettes 400 come into contact with each other on the rotation shaft 201.

Figure 32:
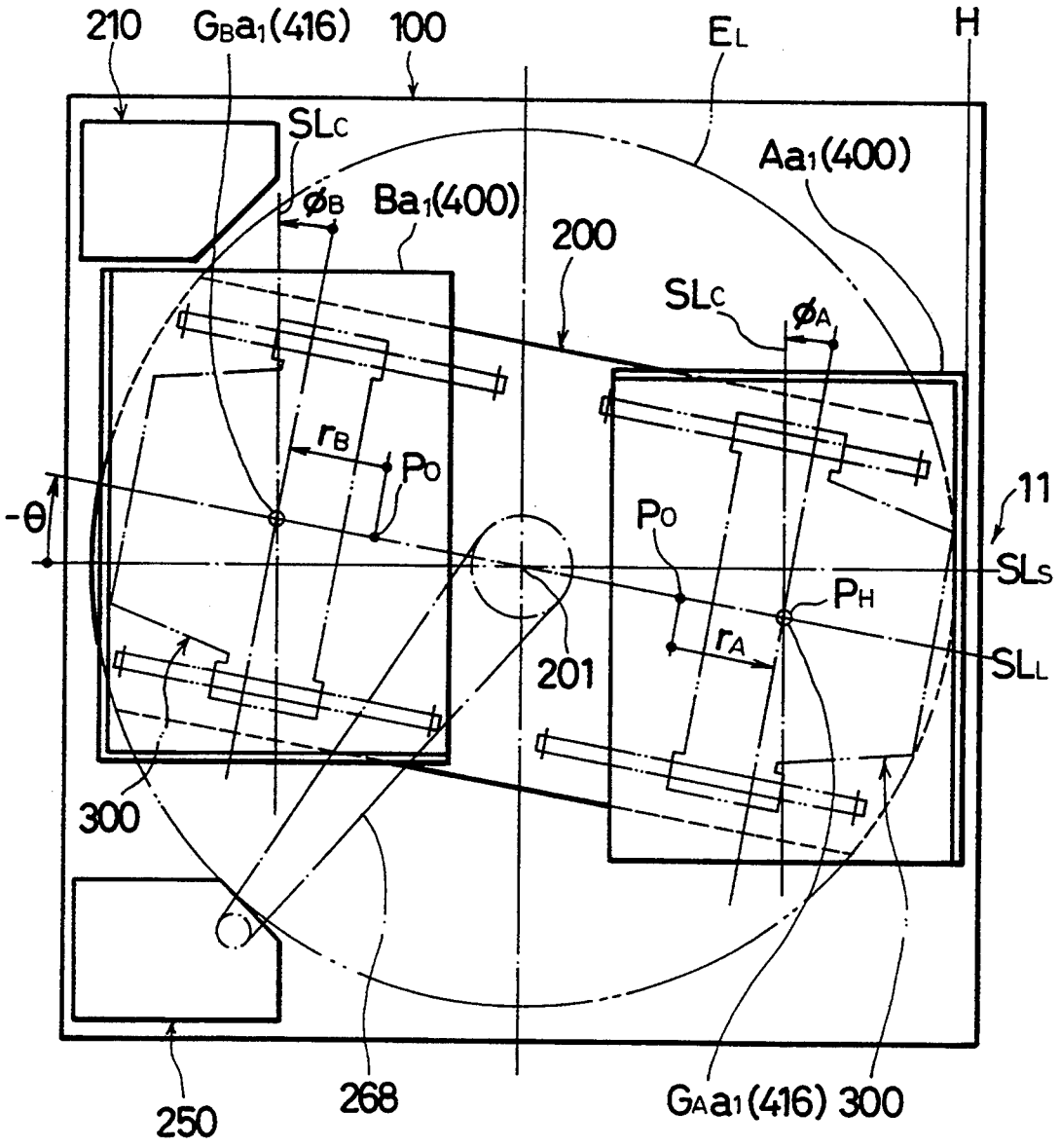
FIG. 32 is an explanatory view illustrating the states of the turntable, carriages and paper cassettes at time $a_1$ during Operation 1 shogun in FIGS. 25 and 26.

The sideways feed position is a position at which, as shown in FIG. 32, the paper cassette 400 on the feeding side 11 is placed for sideways feed while aligning its leading edge with a predetermined cassette leading edge setting line H.

Figure 33:
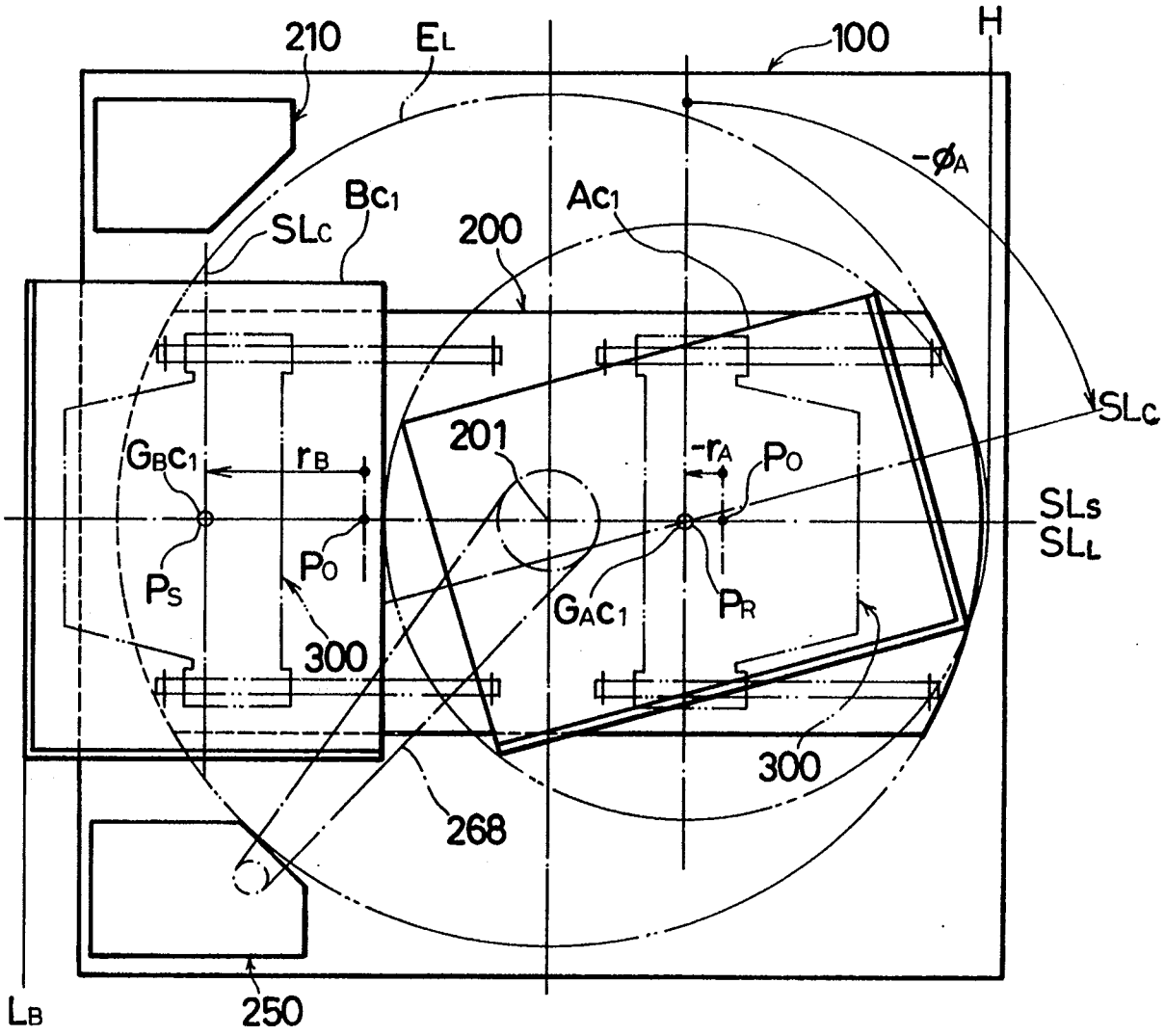
FIG. 33 is an explanatory view illustrating the states of the turntable, carriages and paper cassettes at time $c_1$ during Operation 1 shown in FIGS. 25 and 26.

The retracted position is a position at which, as illustrated in FIG. 33, the paper cassette 400 on the feeding side 11 is retraced toward the non-feeding side so as to prevent it from protruding from the cassette leading edge setting line H during switching of the position of the paper cassette 400 on the feeding side 11 between lengthways and sideways feed.

Figure 21:
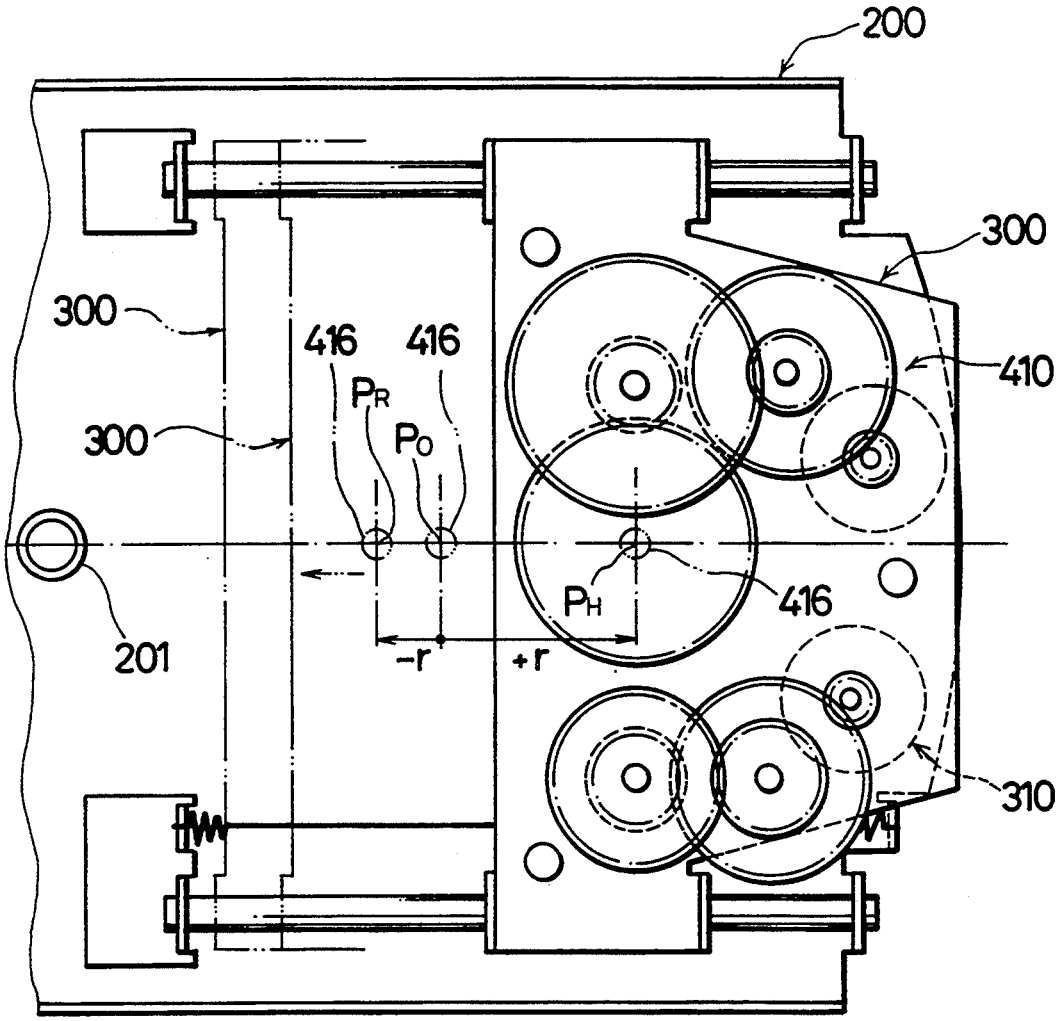
FIG. 21 is a schematic plan view illustrating the operation of the carriage driving mechanism shogun in FIGS. 10 and 11.
Figure 22:
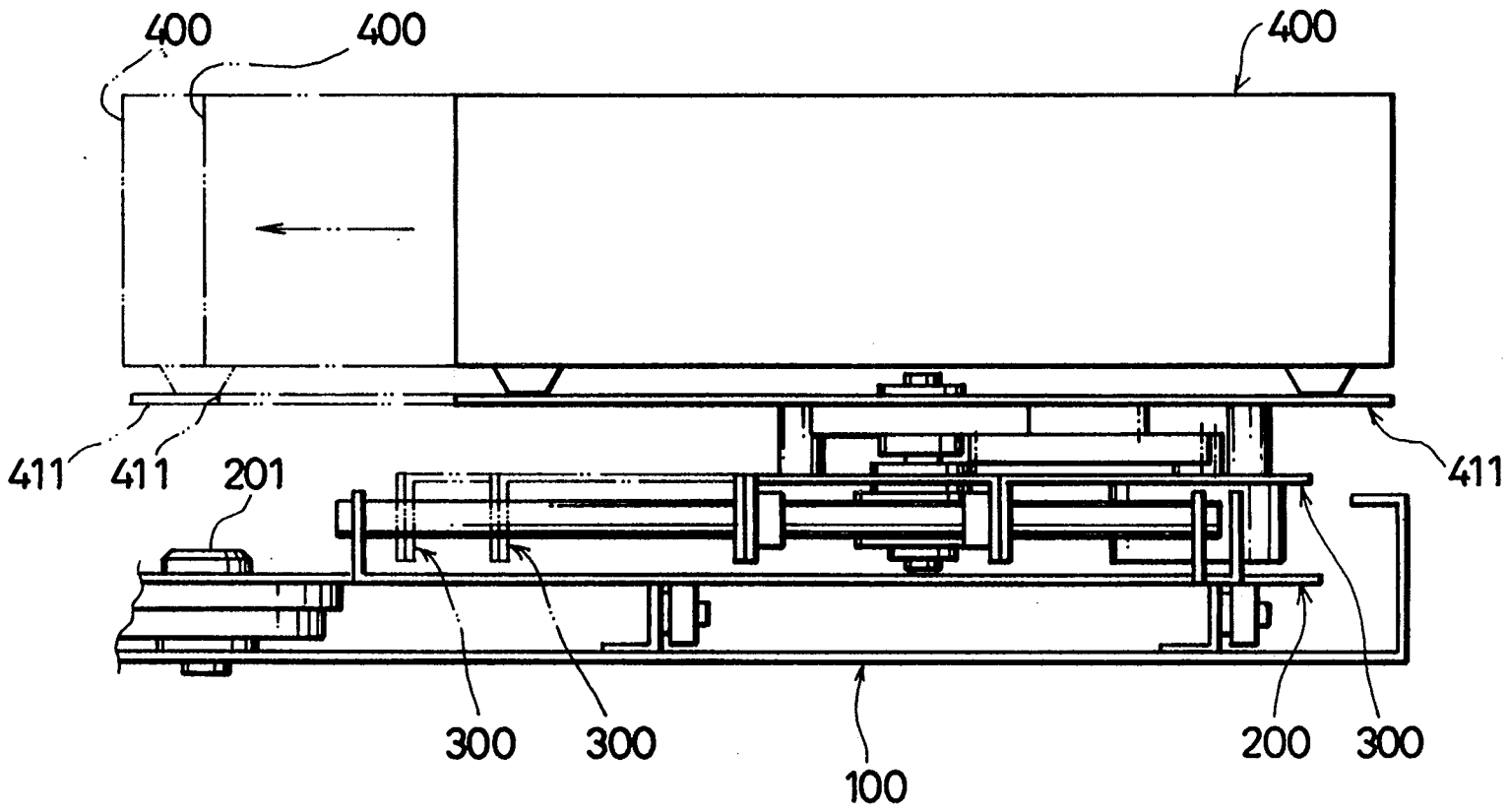
FIG. 22 is a schematic front view illustrating the movement of a paper cassette caused by the movement of the carriage show in FIG. 21.

When the paper cassette 400 is moved toward the interchanging, sideways feed or retracted position, as shown in FIG. 21, the cassette rotation shaft 416 is moved to a interchanging point PO, sideways feed point $P_H$ or retracted point PR, respectively. FIG. 22 shows the movement of the paper cassette 400. Here, the interchanging point $P_O$ is defined as a reference point with respect to the movement of the paper cassette 400 driven by the carriage driving mechanism 310. With respect to the interchanging point $P_O$, a direction toward the rotation shaft 201, i.e., toward the retracted point $P_R$ is regarded as a negative (−) direction and the opposite direction, i.e., toward the sideways feed point $P_H$ is a positive (+) direction.

Also, the carriage driving mechanism 310 drives the carriage 300 such that the paper cassette 400 on the non-feeding side is moved between the interchanging position and a clearance position. The clearance position is a position at which the paper cassette 400 on the non-feeding side protrudes from the tray 100 toward a direction opposite to the rotation shaft 201 and aligns with a predetermined clearance line $L_B$ as illustrated in FIG. 33. When the paper cassette 400 on the non-feeding side is located in the clearance position, it does not interfere with the rotation of the paper cassette 400 on the feeding side 11 for switching its state between the sideways feed and lengthways feed. The cassette rotation shaft 416 is moved from the interchanging point $P_O$ shown in FIG. 38 to the clearance point $P_S$ shown in FIG. 33 as the paper cassette 400 on the non-feeding side is moved from the interchanging position to the clearance position.

During $\phi$-axis driving by the cassette rotating mechanism 410, the power of the pulse motor 413 is increased at the reduction gear ratio $i_2$ and transmitted to the cassette rotation shaft 416 by the series of power transmission gears shown in FIGS. 14 to 15. The microcomputer 20 controls the cassette rotating mechanism 410 such that:

(1) the paper cassette 400 is rotated for positioning the paper for a sideways or lengthways feed;

(2) in accordance with the rotation of the turntable 200 driven by the $\theta$-axis driving, the paper cassette 400 is rotated for positioning the leading edge of the paper fed from the paper cassette 400 at right angles to the feeding direction; and (3) the longer sides of the paper cassette 400 on the non-feeding side are positioned at right angles to the feeding center line $SL_S$ during the rotation of the turntable 200 driven by the 180-degree rotating mechanism 210 and during the switching of the position of the paper cassette 400 on the feeding side 11 between sideways feed and lengthways feed.

By a combination of driving of the turntable 200 by the 180-degree rotating mechanism 210, $\theta$-axis driving, r-axis driving and $\phi$-axis driving, the paper cassettes 400 on the feeding side 11 and on the non-feeding side are interchanged and the position of the paper cassette 400 on the feeding side 11 is changed between lengthways feed and sideways feed.

Denoting the two paper cassettes 400 in the rotatable cassette unit 4 as cassette No.1 and cassette No. 2, they fall into four modes, Modes 1 to 4, on the feeding side 11 as described below.

Mode 1—cassette No. 1 is positioned for sideways feed

Mode 2—cassette No. 1 is positioned for lengthways feed

Mode 3—cassette No. 2 is positioned for sideways feed

Mode 4—cassette No. 2 is positioned for lengthways feed

Figure 23:
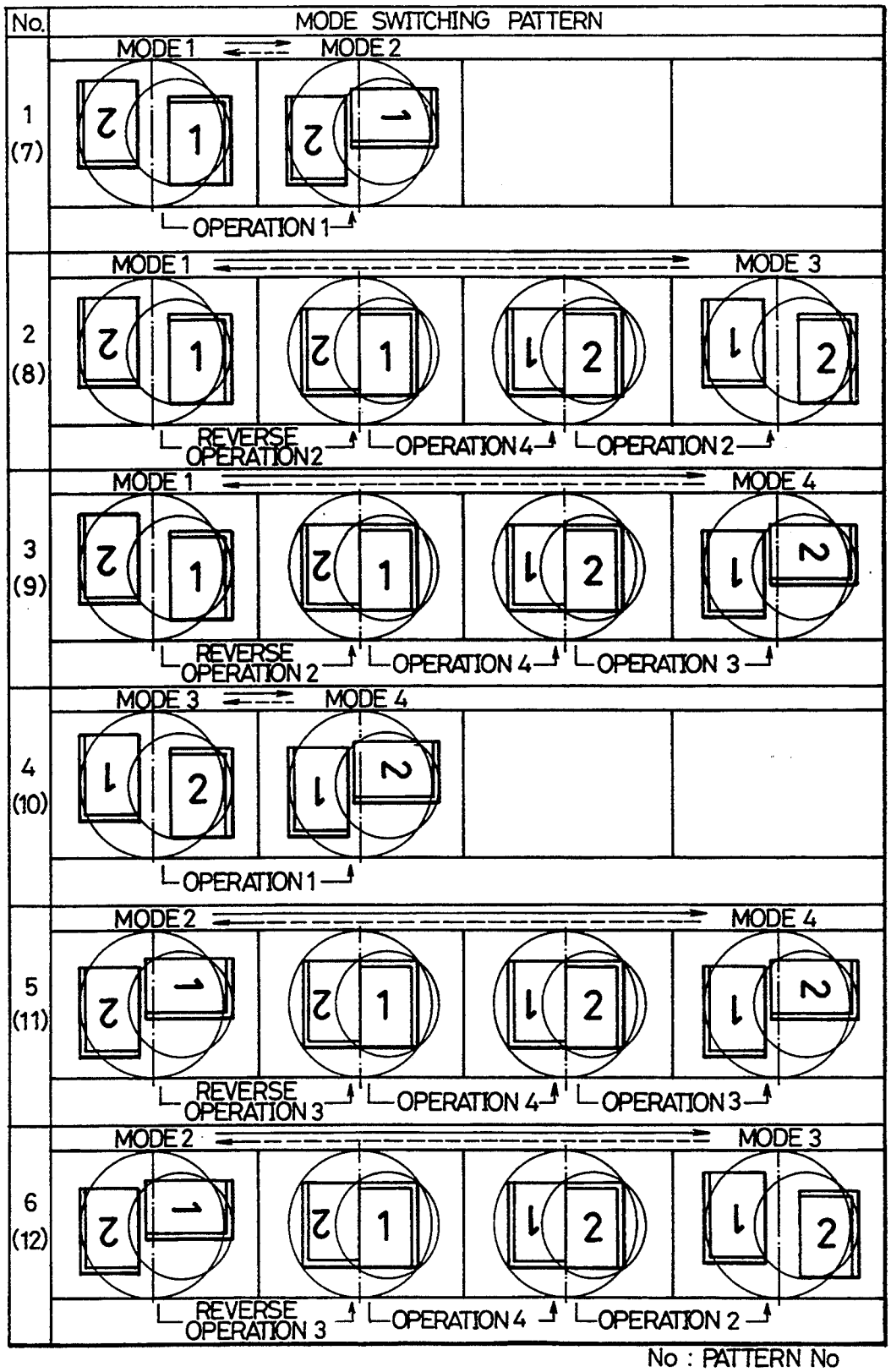
FIG. 23 is an explanatory view illustrating patterns of mode switching executed by the 180-degree rotating mechanism, small angle rotating mechanism, carriage driving mechanisms and cassette rotating mechanisms shown in FIGS. 4 through 17.

As for switching of modes from one mode to other three modes, there are twelve switching patterns in total. However, six,-a half of the twelve switching patterns, are reverse operations of the other six. Therefore, only six switching patterns shown in FIG. 23 will be explained here. In FIG. 23, switching operations from one mode to other modes are indicated with the solid lines, while their reverse operations are indicated with the broken lines. Besides, in each mode, the right is the feeding side 11 and the left is the non-feeding side.

A single switching pattern is constituted by a single operation or a combination of four operations 1 to 4 and their reverse operations 1 to 4 described below.

Operation 1—switching the position of the paper cassette 400 on the feeding side 11 between lengthways feed and sideways feed Operation 2—after interchanging the paper cassettes 400 on the feeding side 11 and on the non-feeding side, positioning the paper cassette 400 in the feeding side 11 for sideways feed Operation 3—after interchanging the paper cassettes 400 on the feeding side 11 and on the non-feeding side, positioning the paper cassette 400 on the feeding side 11 for lengthways feed Operation 4—interchanging the paper cassettes 400 on the feeding side 11 and on non-feeding side FIG. 24 illustrates combinations of Operations 1 to 4 and Reverse Operations 1 to 4 constituting the respective mode switching patterns. Reverse Operations 1 to 4 are carried out by reversing the rotation of the corresponding motors.

Since the microcomputer 20 memorizes the mode switching patterns shown in FIG. 23 and their constituent operations shown in FIG. 24, after selecting a size of paper to be fed from B5, B5R, A4 and A4R it con, hands the execution of operations constituting a mode switching pattern selected. This permits the selected paper to be placed in the feeding position in accordance with the selected mode. Further, as for control of the 180-degree rotating mechanism 210, small angle rotating mechanism 250, carriage driving mechanism 310 and cassette rotating mechanism 410, by separating a series of the controlling operations into the above-mentioned four operations 1 to 4, the process of controlling each mechanism is simplified.

The following will discuss Operations 1 to 4 controlled by the microcomputer 20. Firstly, Operation 1 of switching modes from Mode 1 to. Mode 2 will be explained. It is assumed herein that the paper cassette 400 for B5-sized paper is located on the feeding side 11 and the paper cassette 400 for A4-sized paper is located on the non-feeding side.

Figure 25:
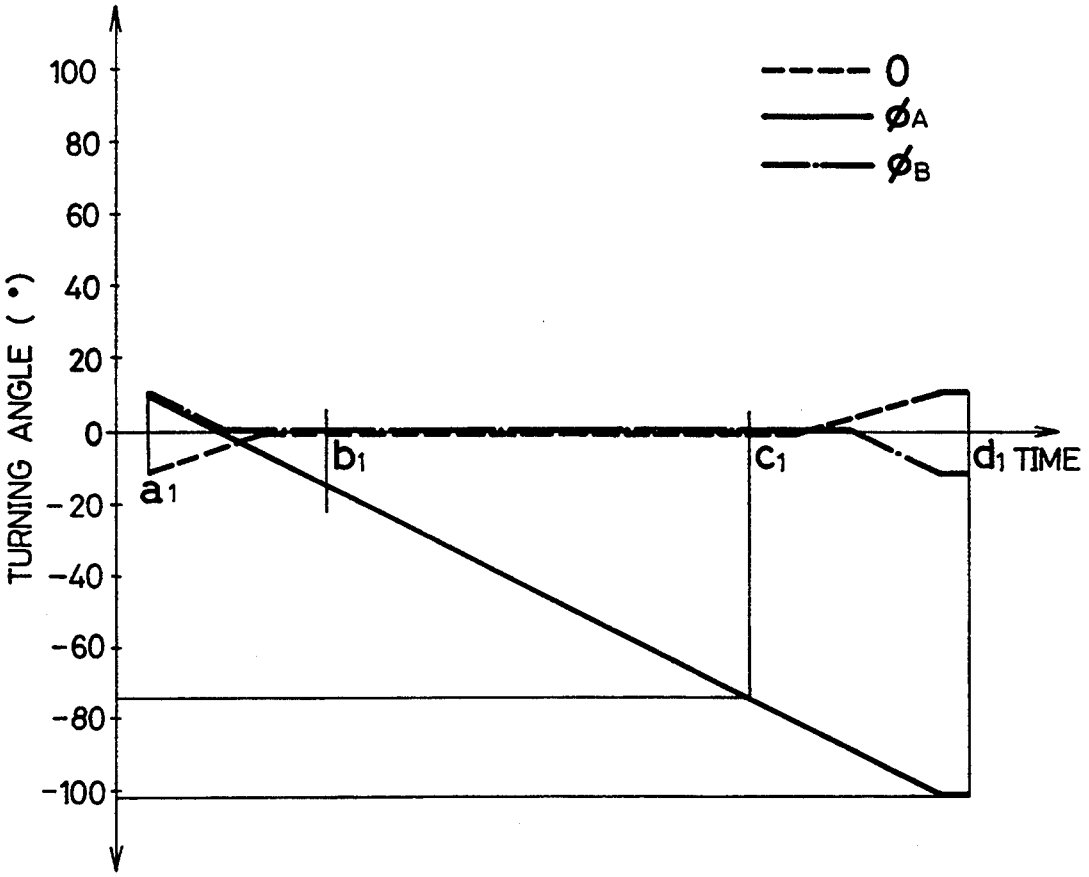
FIG. 25 is a graph illustrating the relations between the turning angle ($\theta$) of the rotation shaft +of the turntable and the turning angles ($\phi_A$ and $\phi_B$) of the cassette rotation shafts of the paper cassettes on the feeding side and non-feeding side and time during Operation 1 shown in FIG. 23.
Figure 26:
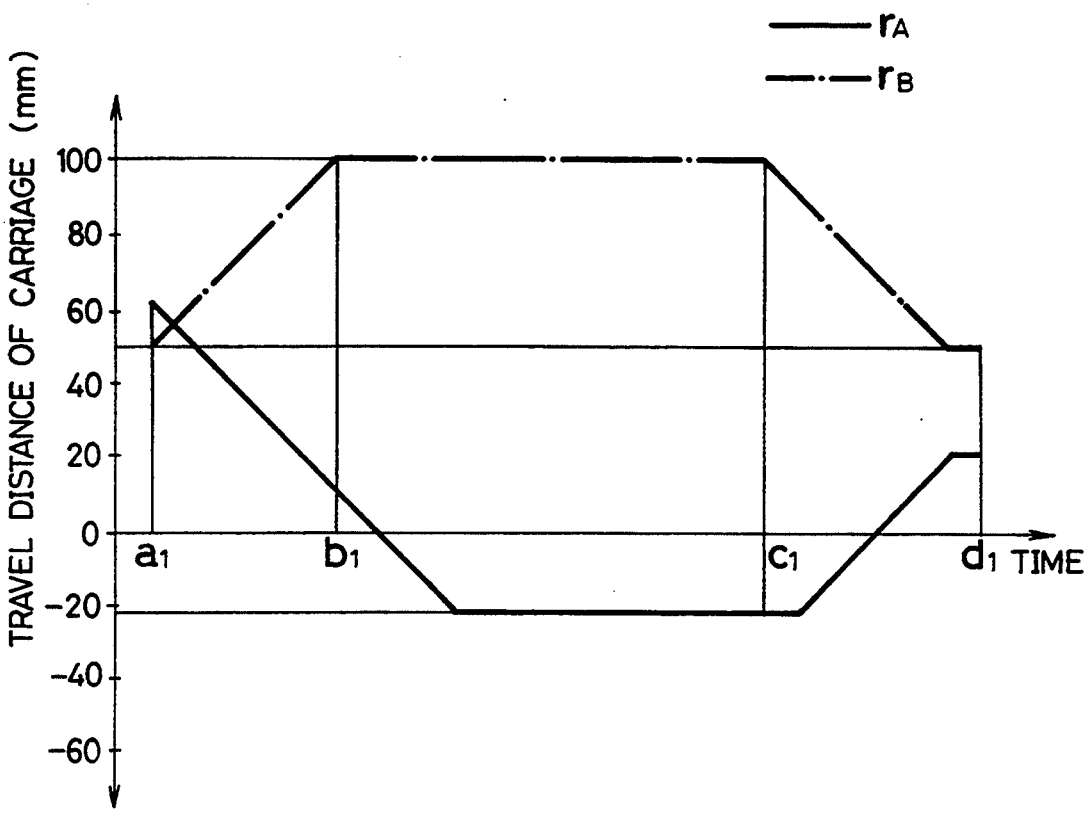
FIG. 26 is a graph illustrating the relations between the travel distances ($r_A$ and $r_B$) of the carriages on the feeding side and non-feeding side and time during Operation 1 shown in FIG. 23.

In Operation 1, to shorten the operation time, the $\theta$-axis driving and the $\phi$-axis driving shown in FIG. 25 and the r-axis driving shown in FIG. 26 are simultaneously controlled. As described above, the small angle rotating mechanism 250 rotates the turntable 200 during the $\theta$-axis driving, the cassette rotating mechanism 410 rotates the paper cassette 400 during the $\phi$-axis driving, and the carriage driving mechanism 310 moves the carriage 300 during the r-axis driving. Similarly, the $\phi$-axis driving, $\phi$-axis driving and r-axis driving are simultaneously controlled in Operations 2 and 3.

As illustrated in FIG. 32, $\theta$ represents the displacement of the rotation shaft 201 of the turntable 200, i.e., turning angle. This is an angle between the feeding center line $SL_S$ and the center line $SL_L$ of the rotated turntable 200. The turntable center line $SL_L$ extends in the longitudinal direction of the turntable 200 while passing through the cassette rotation shafts 416 of the two paper cassettes 400 and the rotation shaft 201 of the turntable 200. Additionally, with regard to $\theta$, the displacement in the counterclockwise direction is given by a positive (+) value and the displacement in the clockwise direction is given by a negative (−) value.

Each of $\phi$A and $\phi$B represents the turning angle of the paper cassette 400 with respect to the turntable center line $SL_L$. Supposing that a cassette center line $SL_C$ crosses the feeding center line $SL_S$ at right angles when the paper cassette 400 is in a state $Aa_1$ for sideways feed, the turning angle indicates the amount of movement of the cassette center line $SL_C$ when it crosses the turntable center line $SL_L$ at right angles. With regard to $\phi$A and $\phi$B, similar to the above, the displacement in the counterclockwise direction is given by a positive (+) value and the displacement in the clockwise direction is given by a negative (−) value.

Each of $r_A$ and $r_B$ shown in FIG. 26 represents the travel distance of the cassette rotation shaft 416 from the interchanging point $P_O$ shown in FIG. 21 as the result of the movement of the carriage 300. Regarding the travel distance, the movement from the interchanging point $P_O$ toward the rotation shaft 201 is given by a negative (−) value and the movement in the opposite direction is given by a positive (+) value.

In this embodiment, since the reduction gear ratios $i_1$, $i_2$ and $i_4$ are set for the $\theta$-axis driving, r-axis driving and 100 -axis driving respectively, the $\theta$-axis driving, r-axis driving and 100 -axis driving are controlled simultaneously by a uniform-speedmotion, for example, by maintaining the relations, $r:\phi:\theta=2$ mm:1°:0.5°. In this embodiment, this operation is performed by driving the pulse motors 258, 311 and 413 as power source at a frequency, 100PPS, 7.5°/step.

Figure 27:
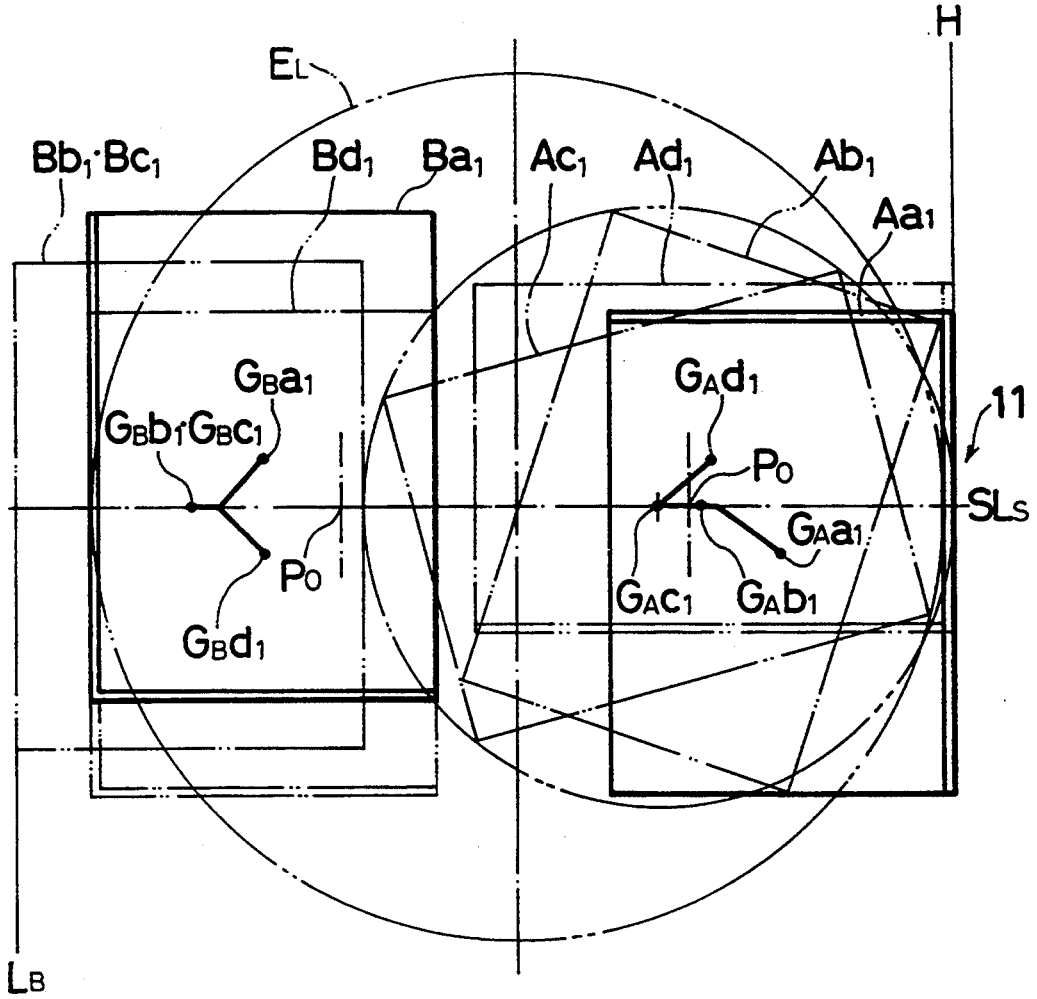
FIG. 27 is an explanatory view illustrating the locations of the cassette rotation shafts and the paper cassettes at time $a_1$ through time $d_1$ with relation to the rotation of the turntable's rotation shaft and of the cassette rotation shafts shown in FIG. 25 and the movements of the carriages shown in FIG. 26.

In the case of Operation 1 for changing modes from Mode 1 to Mode 2, by the controlling the operation as shown in FIGS. 25 and 26, the position of the cassette A on the feeding side 11 storing B5-sized paper is moved as shown in FIG. 27. More specifically, as time goes by from start time $a_1$ to time $b_1$, $c_1$ and $d_1$, the position of the cassette A is changed from the sideways feed state $Aa_1$ drawn with the solid line to a lengthways feed state $Ad_1$ via states $Ab_1$ and $Ac_1$ illustrated with the alternate long and two short dashes lines.

During Operation 1, the cassette A on the feeding side 11 is moved such that its leading edge is moved substantially along the predetermined cassette leading edge setting line H without causing it to protrude from the cassette leading edge setting line H. It is arranged that the cassette leading edge setting line H and the leading edge of the cassette A are in alignment when the cassette A is set in the sideways feed position or in the lengthways feed position. Moreover, denoting the cassette rotation shaft 416 of the cassette A and the cassette rotation shaft 416 of the cassette B as a cassette rotation shaft $G_A$ and a cassette rotation shaft $G_B$, respectively, the cassette rotation shaft $G_A$ is moved to $G_Aa_1$ to $G_Ad_1$ in accordance with the states $Aa_1$ to $Ad_1$ of the cassette A.

As for a cassette B on the non-feeding side, to avoid interference between the cassettes A and B, it is moved from a sideways feed state $Ba_1$ drawn with the solid line to a state $Bd_1$ via states $Bb_1$ and $Bc_1$ illustrated with the alternate long and two short dashes lines as time goes by from start time $a_1$ to time, $b_1$, $c_1$ and $d_1$. As a result, the cassette rotation shaft $G_B$ is moved to $G_Ba_1$ to $G_Bd_1$ in accordance with the states $Ba_1$ to $Bd_1$ of the cassette B.

Figure 28:
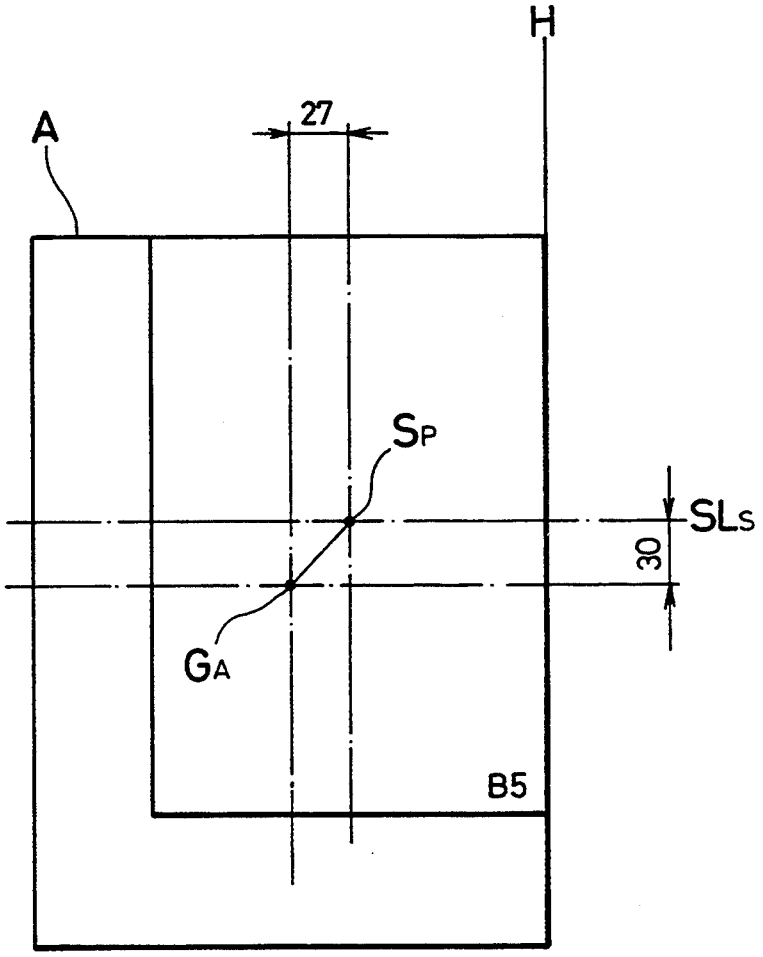
FIG. 28 is an explanatory view illustrating the relation among the feeding center line $SL_S$, the paper center $S_P$ of B5-sized paper stored in the paper cassette and the cassette rotation shaft $G_A$ when the paper cassette is placed in the sideways feed position.

As illustrated in FIG. 28, when the cassette A is in the sideways feed state $Aa_1$, the feeding center line $SL_S$ of the multi-stage feeding device 2 and the paper center $S_P$ of the paper stored in the cassette A are controlled to come into alignment. For instance, since the B5-sized paper is stored while aligning two sides of the paper against one of the longer and shorter sides of the cassette A, the paper center $S_P$ and the cassette rotation shaft $G_A$ come into an offset state. Therefore, the cassette rotation shaft $G_A$ and the feeding center line $SL_S$ are out of alignment.

Figure 29:
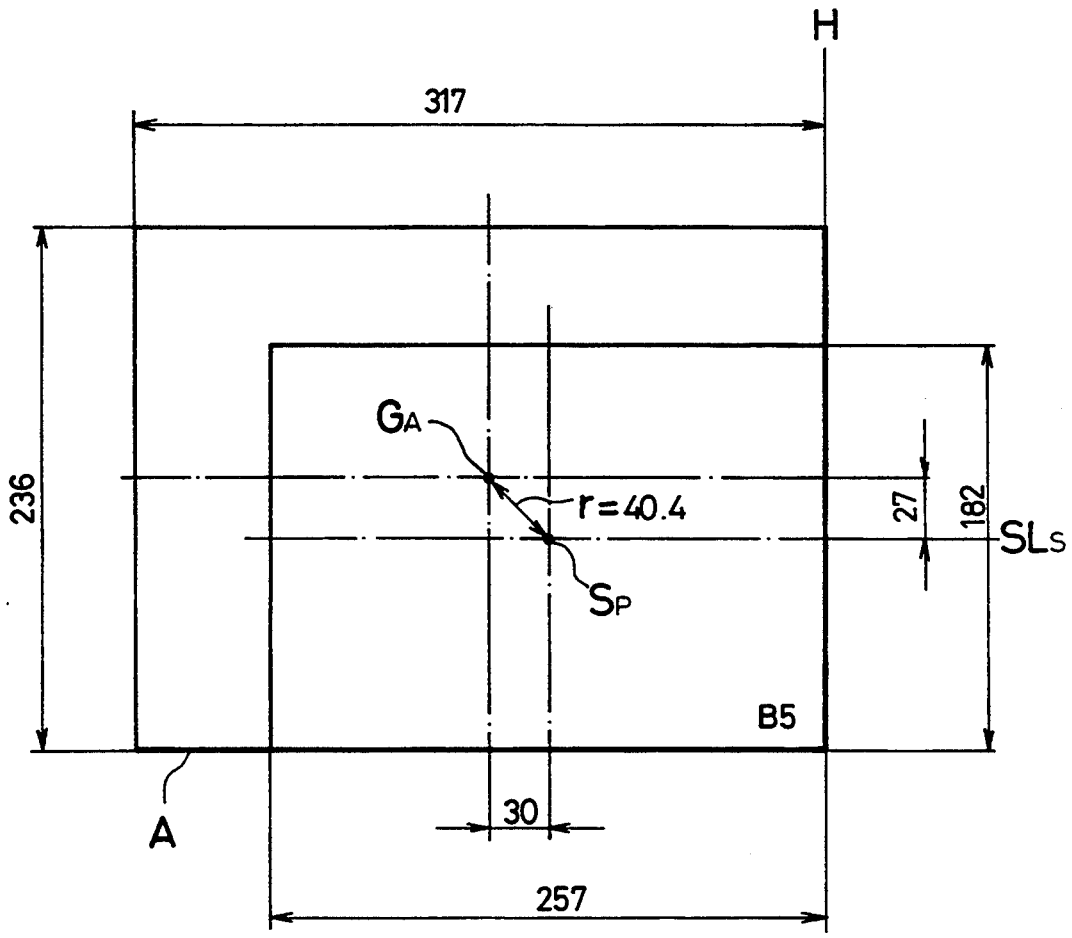
FIG. 29 is an explanatory view illustrating the relation among the feeding center line $SL_S$, the paper center $S_P$ of B5-sized paper stored in the paper cassette and the cassette rotation shaft $G_A$ when the paper cassette is placed in the lengthways feed position.
Figure 30:
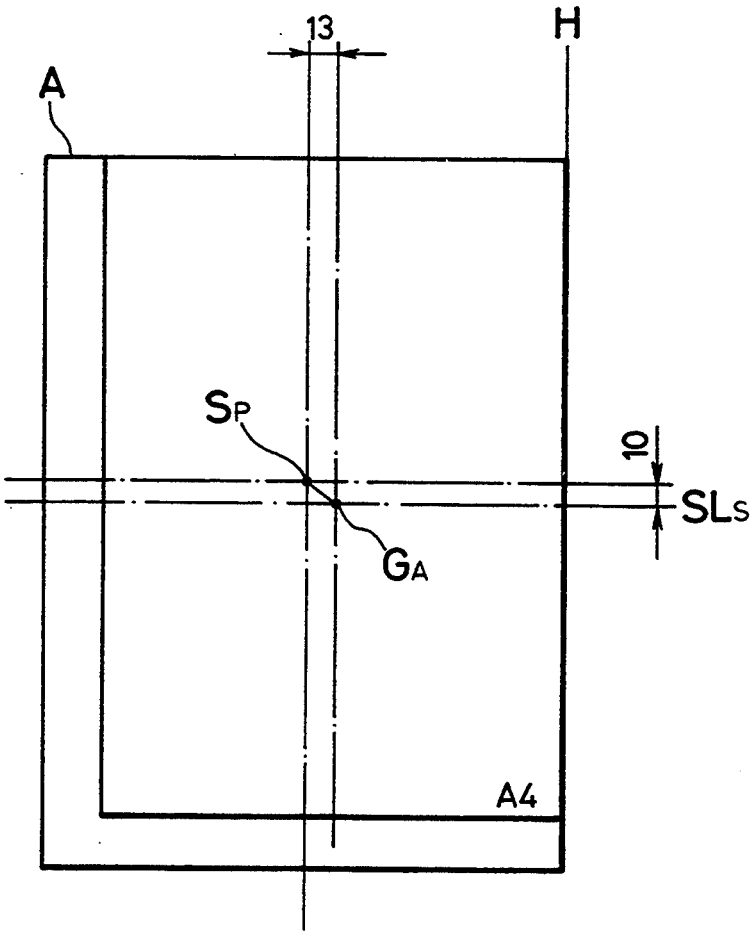
FIG. 30 is an explanatory view illustrating the relation among the feeding center line $SL_S$, the paper center $S_P$ of A4-sized paper stored in the paper cassette and the cassette rotation shaft $G_A$ when the paper cassette is placed in the sideways feed position.
Figure 31:
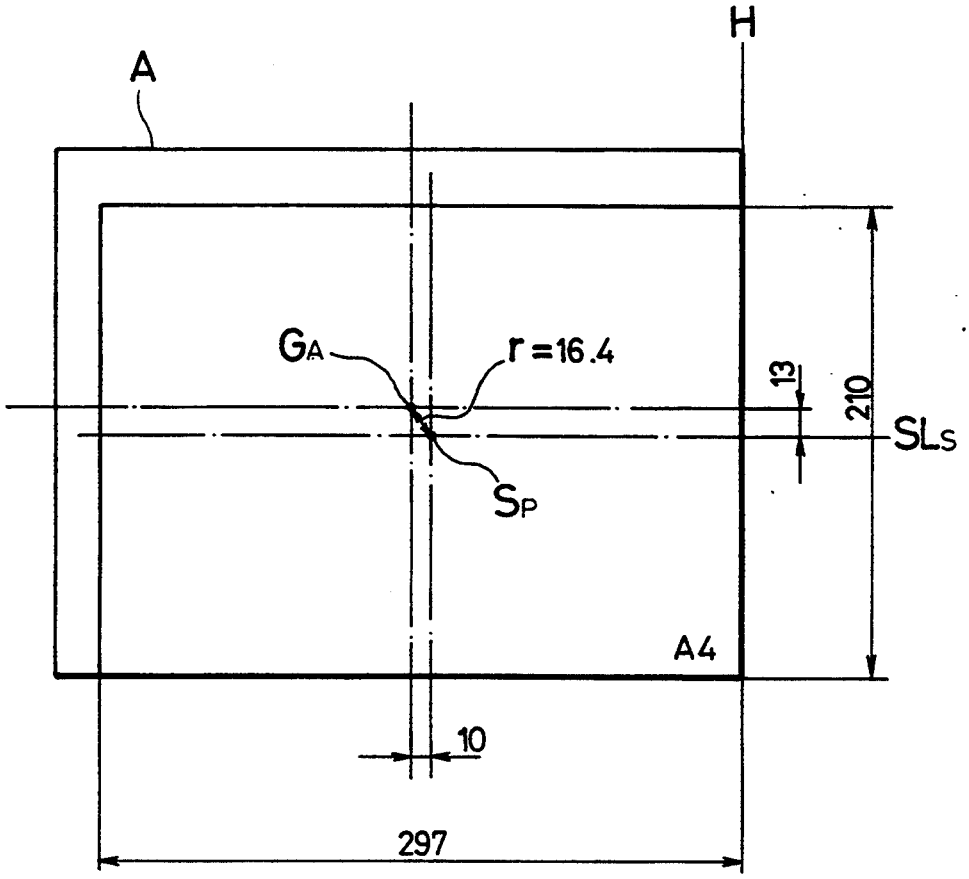
FIG. 31 is an explanatory view illustrating the relation among the feeding center line $SL_S$, the paper center $S_P$ of A4-sized paper stored in the paper cassette and the cassette rotation shaft $G_A$ when the paper cassette is placed in the lengthways feed position.

Similarly, the paper center $S_P$ and the cassette rotation shaft $G_A$ are out of alignment when B5-sized paper is stored in the cassette A positioned for lengthways feed as shown in FIG. 29, when A4-sized paper is stored in the cassette A positioned for sideways feed as shown in FIG. 30, and when A4-sized paper is stored in the cassette A positioned for lengthways feed as shown in FIG. 31. In each case, the cassette rotation shaft $G_A$ is in an offset state with respect to the feeding center line $SL_S$.

Therefore, when the cassette A on the feeding side 11 is in the sideways feed state $Aa_1$, i.e., at start time $a_1$, as illustrated in FIG. 32, the turntable 200 is turned by $-\theta$degrees by the $\theta$-axis driving in order to align the paper center $S_P$ shown in FIG. 28 with the feeding center line $SL_S$. At this time, the cassette rotation shaft $G_A$ is also rotated by $+\phi_A$ degrees by the $\phi$-axis driving as shown in FIG. 32 so that the leading edge of the paper crosses the feeding center line $SL_S$ at right angles. Further, the carriage 300, i.e., the cassette rotation shaft $G_A$ is moved by a distance of $+r_A$ by the r-axis driving in order to align the leading edge of the cassette A with the cassette leading edge setting line H. On the contrary, regarding the cassette B on the non-feeding side, the cassette rotation shaft $G_B$ is rotated by an angle of $+\phi_B$ that is equal to $\phi_A$ and moved by a distance of $+r_B$.

At time $b_1$ the turning angle $\theta$ of the turntable 200 is 0°, i.e., the turntable 200 is in a stationary state and the turntable center line $SL_L$ is parallel with the feeding center line $SL_S$. In this state, the rotation shaft $G_A$ is rotated with a uniform speed toward the negative direction by the $\phi$-axis driving, and the cassette A is moved in the negative direction with respect to the point $G_Aa_1$ by the r-axis driving without causing its leading edge to protrude from the cassette leading edge setting line H.

Meanwhile, with regard to the cassette B, as illustrated in FIG. 33 at time $c_1$ the turning angle $\phi_B$ of the cassette rotation shaft $G_B$ is 0°, i.e., the turntable 200 is in a stationary state and the cassette center line $SL_C$ crosses the turntable center line $SL_L$ at right angles. In this state, the cassette rotation shaft $G_B$ is moved maximally in the positive direction from the interchanging point $P_O$ to a clearance point $P_S$, for example, by $r_B$ or 101 mm, and stopped. Accordingly, the cassette B is stopped at the clearance position located furthest away from the rotation shaft 201. At the clearance position, an edge of the cassette B protrudes from the tray 100 to the clearance line $L_B$ and the cassette center line $SL_C$ crosses the feeding center line $SL_S$ at right angles.

At time $c_1$, as illustrated in FIG. 33, the states of the turntable 200 and the cassette B on the non-feeding side are the same as those at time $b_1$. At this time, with regard to the cassette A on the feeding side 11, the cassette rotation shaft $G_A$ is rotated with a uniform speed toward the negative direction by the $\phi$-axis driving while being moved to the retracted point $P_R$ by the r-axis driving. In this figure, the cassette rotation shaft $G_A$ is rotated by an angle of $\phi_A$, that is, −75 degrees.

Figure 34:
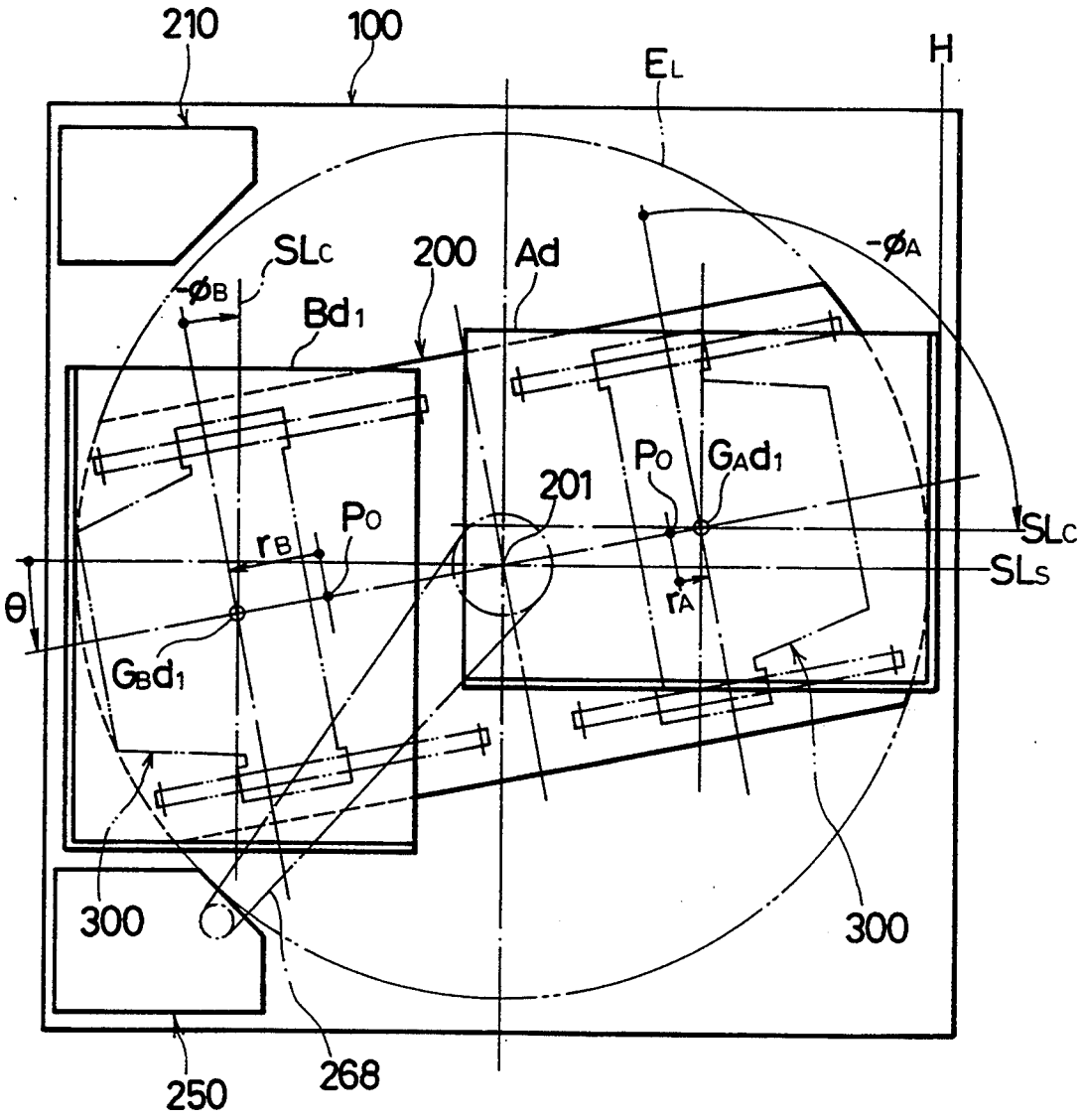
FIG. 34 is an explanatory view illustrating the states of the turntable, carriages and paper cassettes at time $d_1$ during Operation 1 shown in FIGS. 25 and 26.

At time $d_1$ Operation 1 is completed. As illustrated in FIG. 34, the turntable 200 is turned by $+\theta$ degrees by the $\theta$-axis driving in order to align the paper center $S_P$ shown in FIG. 31 with the feeding center line $SL_S$, and is stopped. At this time, with regard to the cassette A, the cassette rotation shaft $G_A$ is rotated by $-\phi_A$ degrees by the $\phi$-axis driving so that the cassette center line $SL_C$ is parallel with the feeding center line $SL_S$ and that the leading edge of the paper crosses the feeding center line $SL_S$ at right angles. Further, the cassette rotation shaft $G_A$ is moved by a distance of $+r_A$ shown in FIG. 34 by the r-axis driving in order to align the leading edge of the cassette A with the cassette leading edge setting line H. On the contrary, regarding the cassette B on the non-feeding side, the cassette rotation shaft $G_B$ is rotated by an angle of $-\phi_B$ and moved by a distance of $+r_B$ that is equal to the travel-distance in the state $Ba_1$.

Operation 2 will be explained below.

Figure 35:
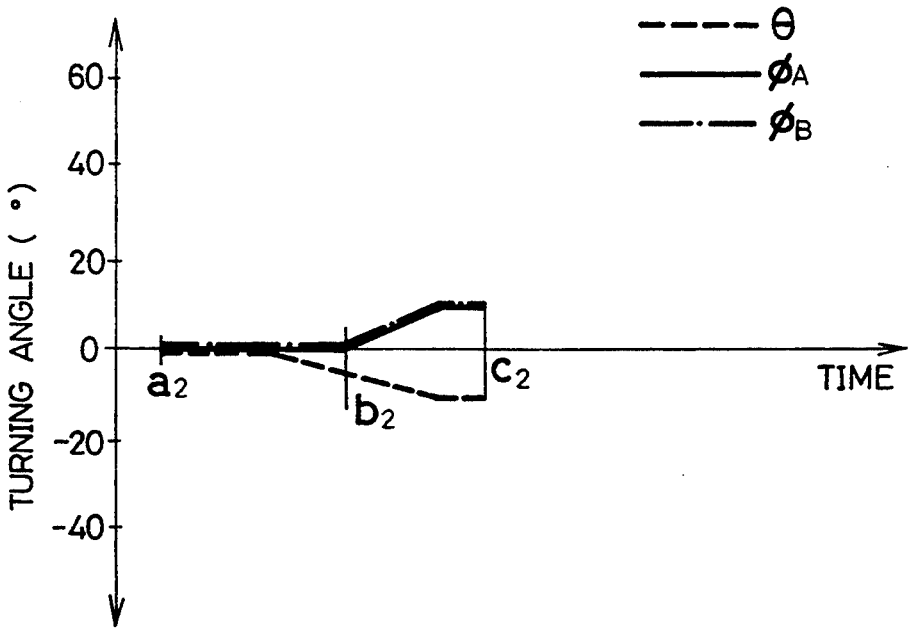
FIG. 35 is a graph illustrating the relations between the turning angle ($\theta$) of the rotation shaft of the turntable and the turning angles ($\phi_A$ and $\phi_B$) of the cassette rotation shafts of the paper cassettes on the feeding side and non-feeding side and time during Operation 2 shown in FIG. 23.
Figure 36:
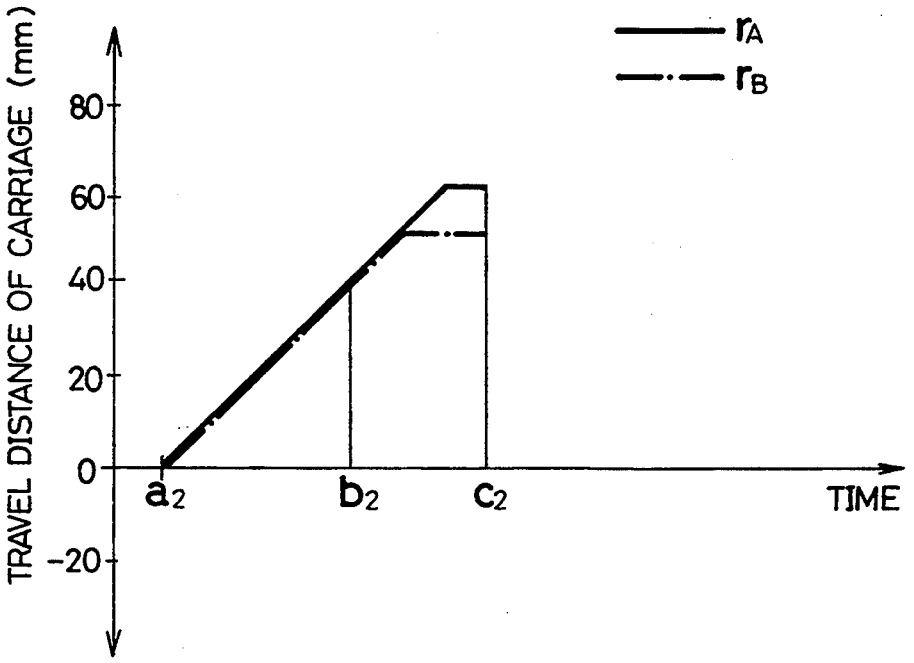
FIG. 36 is a graph illustrating the relations between the travel distances ($r_A$ and $r_B$) of the carriages on the feeding side and non-feeding side and time during Operation 2 shown in FIG. 23.
Figure 37:
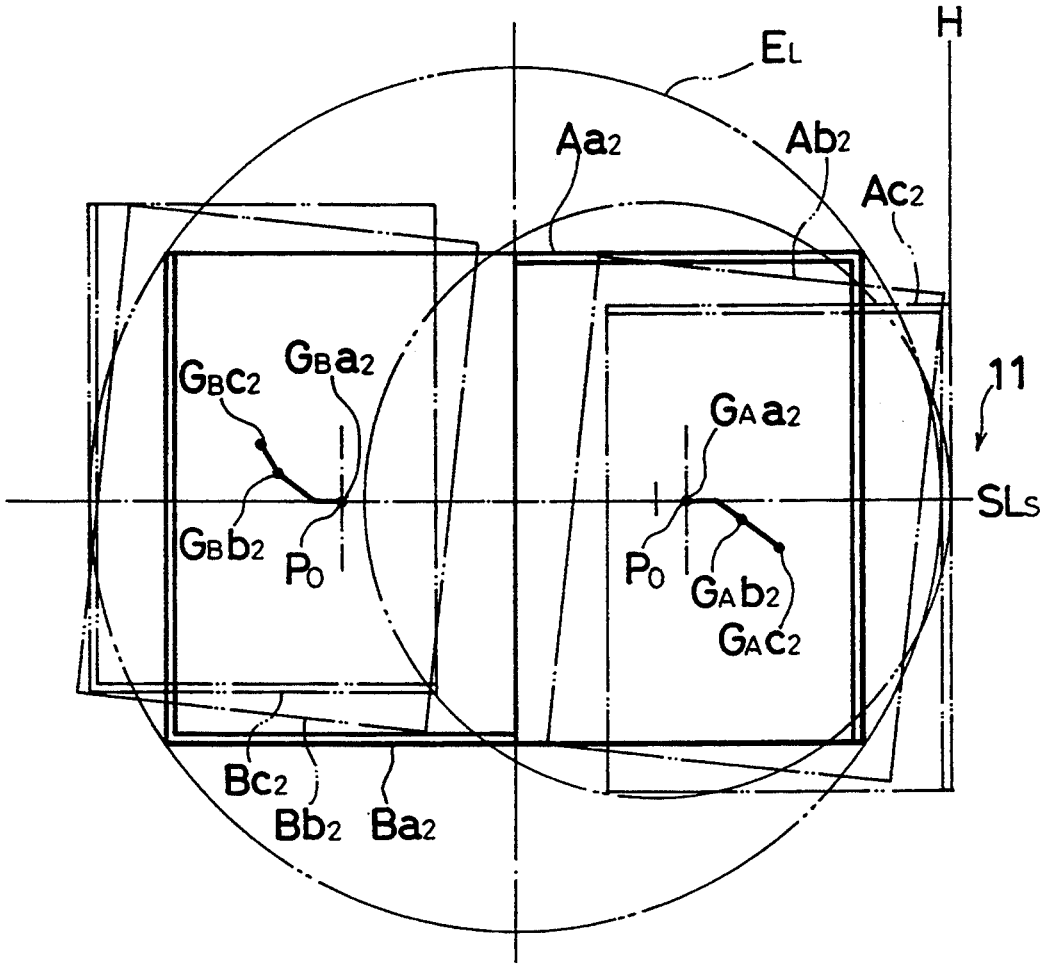
FIG. 37 is an explanatory view illustrating the locations of the cassette rotation shafts and the paper cassettes at time $a_2$ through time $c_2$ with relation to the rotation of the turntable's rotation shaft and of the cassette rotation shafts shown in FIG. 35 and the movements of the carriages shown in FIG. 36.

In Operation 2, as described above, after interchanging the paper cassettes 400 on the feeding side 11 and on the non-feeding side, the paper cassette 400 on the feeding side 11 is positioned for sideways feed. The Operation 2 is controlled as shown in FIGS. 35 and 36. In the operation, at start time $a_2$ the cassettes A and B are in the states $Aa_2$ and $Ba_2$, i.e., they are in the closest proximity as shown with the solid lines in FIG. 37. Then, as time goes by to time $b_2$ and time $c_2$, they are parted from each other to reach states $Ac_2$ and $Bc_2$ via states $Ab_2$ and $Bb_2$ shown with the alternate long and two short dashes lines. As a result, the cassette A is placed in the sideways feed position. And the rotation shafts $G_A$ and $G_B$ are also moved to $G_Aa_2$ to $G_Ac_2$ and to $G_Ba_2$ to $G_Bc_2$, respectively, in accordance with the states $Aa_2$ to $Ac_2$ and $Ba_2$ to $Bc_2$ of the cassettes A and B.

When Operation 2 is started at time $a_2$, as illustrated in FIG. 38, the turntable 200 is stopped, $\theta=0°$. In this state, both $\phi_A$ and $\phi_B$ are 0 degrees, and the cassette center lines $SL_C$ of the cassettes A and B cross the turntable center line $SL_L$ and the feeding center line $SL_S$ at right angles respectively. In addition, both $r_A$ and $r_B$ are 0, and the cassette rotation shafts $G_A$ and $G_B$ of the cassettes A and B are located on the respective interchanging points $P_O$.

At time $b_2$, the turntable 200 is rotated in the negative direction by the $\theta$-axis driving. At this time, the cassette center lines $SL_C$ of the cassettes A and B still cross the turntable center line $SL_L$ at right angles. Besides, the cassette rotation shafts $G_A$ and $G_B$ of the cassettes A and B are moved from the interchanging points $P_O$ toward the positive direction by the r-axis driving, respectively.

Figure 39:
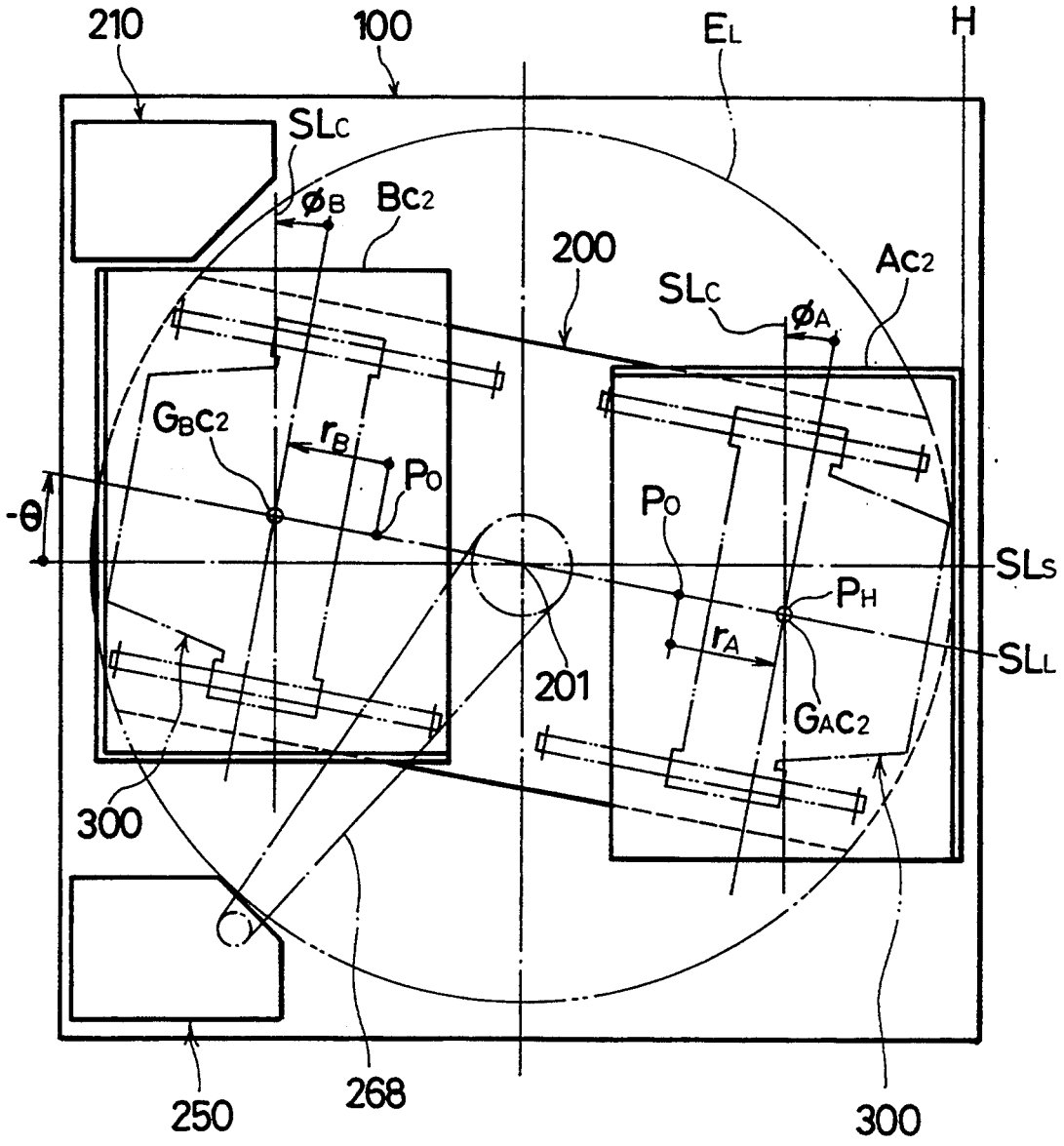
FIG. 39 is an explanatory view illustrating the states of the turntable, carriages and paper cassettes at time $c_2$ during Operation 2 shown in FIGS. 35 and 36.

At time $c_2$, Operation 2 is finished. At this time, as illustrated in FIG. 39, the turntable 200 is turned by $-\theta$ degrees by the $\theta$-axis driving in order to align the paper center $S_P$ with the feeding center line $SL_S$, and is stopped. With regard to the cassette A, the cassette rotation shaft $G_A$ is rotated by $+\phi_A$ degrees by the $\phi$-axis driving so that the cassette center line $SL_C$ crosses the feeding center line $SL_S$ at right angles and that the leading edge of the paper crosses the feeding center line $SL_S$ at right angles. Furthermore, the cassette rotation shaft $G_A$ is moved by a distance of $+r_A$ by the r-axis driving in order to align the leading edge of the cassette A with the cassette leading edge setting line H. On the contrary, regarding the cassette B on the non-feeding side, the cassette rotation shaft $G_B$ is rotated by an angle of $+\phi_B$ that is equal to $+\phi_A$ and moved by a distance of $+r_B$ that is smaller than $r_A$.

The following will explain Operation 3.

Figure 40:
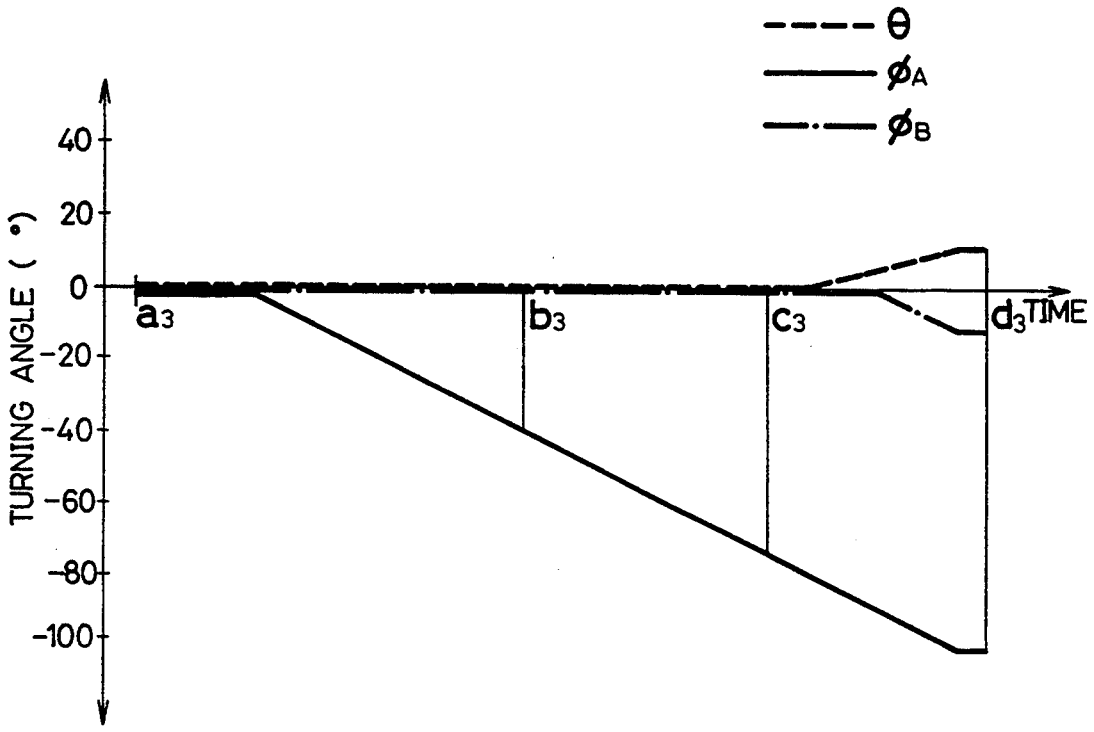
FIG. 40 is a graph illustrating the relations between the turning angle ($\theta$) of the rotation shaft of the turntable and the turning angles ($\phi_A$ and $\phi_B$) of the cassette rotation shafts of the paper cassettes on the feeding side and non-feeding side and time during Operation 3 shown in FIG. 23.
Figure 41:
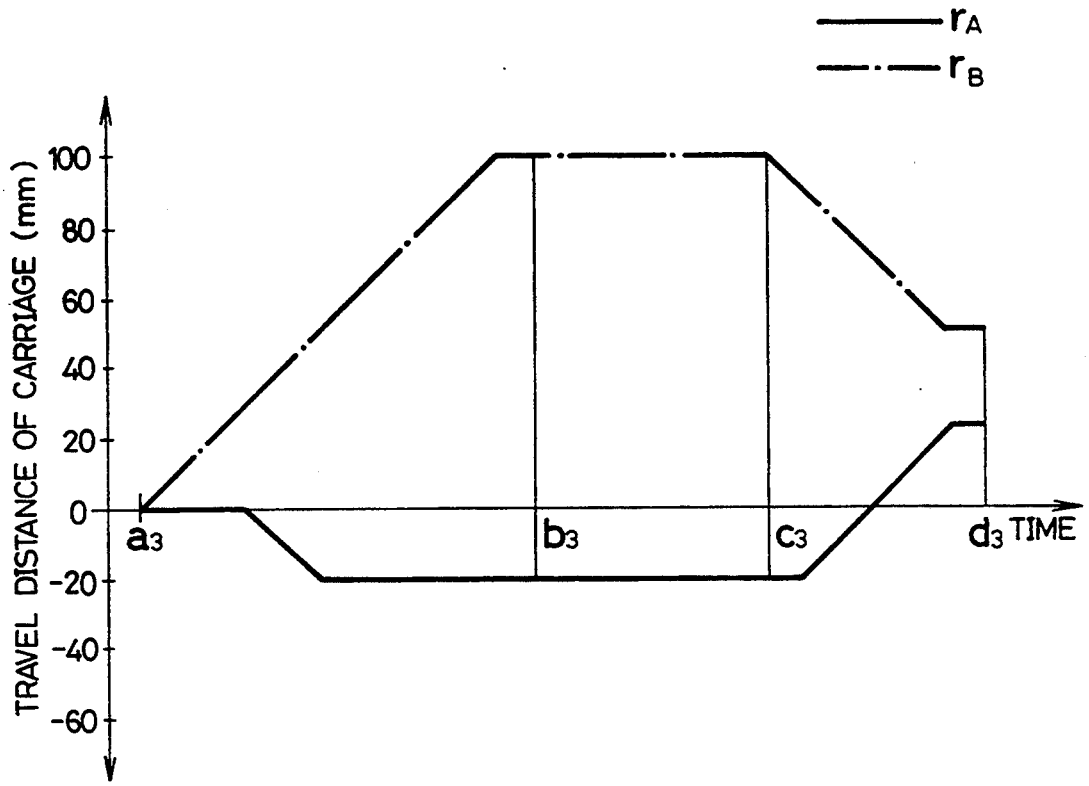
FIG. 41 is a graph illustrating the relations between the travel distances ($r_A$ and $r_B$) of the carriages on the feeding side and non-feeding side and time during Operation 3 shown in FIG. 23.
Figure 42:
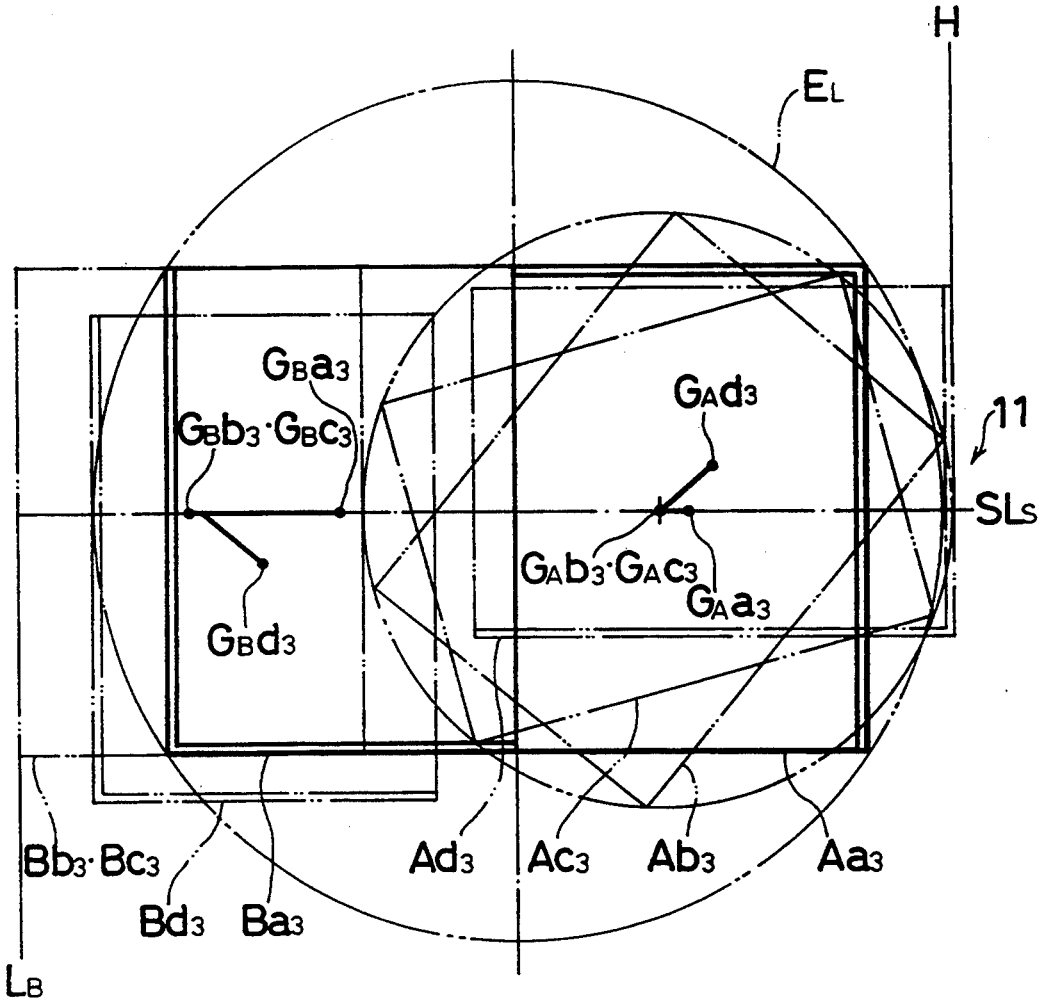
FIG. 42 is an explanatory view illustrating the locations of the cassette rotation shafts and the paper cassettes at time $a_3$ to $d_3$ with relation to the rotation of the turntable's rotation shaft and of the cassette rotation shafts shown in FIG. 40 and the movements of the carriages shown in FIG. 41.

In Operation 3, as described above, after interchanging the paper cassettes 400 on the feeding side 11 and on the non-feeding side, the paper cassette 400 on the feeding side 11 is positioned for lengthways feed. At this time, the operation is controlled as shown in FIGS. 40 and 41. Namely, as illustrated in FIG. 42, the cassettes A and B are in the states $Aa_3$ and $Ba_3$, i.e., they are in the closest proximity as shown with the solid lines at start time $a_3$. Then, as time goes by to time $b_3$, $c_3$ and $d_3$, they are moved such that the cassette A is positioned for lengthways feed and cassette B is in a state $Bd_3$, i.e., a longer side of the cassette B is perpendicular to the longer sides of the cassette A. At that time, the rotation shafts $G_A$ and $G_B$ of the cassettes A and B are also moved to $G_Aa_3$ to $G_Ad_3$ and to $G_Ba_3$ to $G_Bd_3$, respectively.

Figure 43:
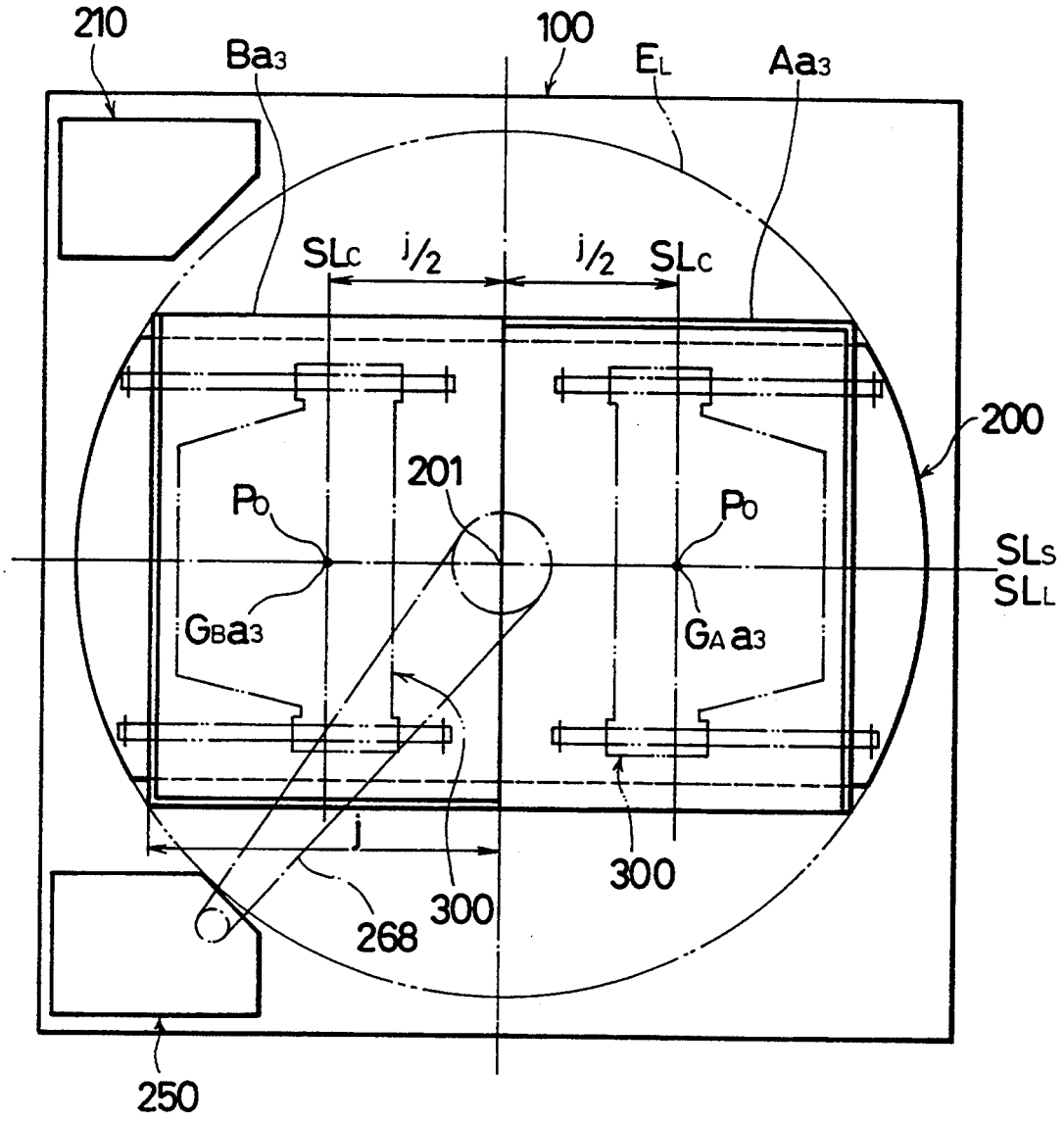
FIG. 43 is an explanatory view illustrating the states of the turntable, carriages and paper cassettes at time $a_3$ during Operation 3 shown in FIGS. 40 and 41.

At time $a_3$, Operation 3 is started. At this time, as illustrated in FIG. 43, the states of the turntable 200 and the cassettes A and B are the same as those at time $a_2$ in Operation 2 shown in FIG. 38.

At time b3, the turntable 200 is still in the stationary state like at time $a_3$. At this time, with regard to the cassette A, the cassette rotation shaft $G_A$ is rotated at a uniform speed toward the negative direction by the $\phi$-axis driving, and is moved from the interchanging point $P_O$ to the retracted point $P_R$ by a distance of $-r_A$ by the r-axis driving. When the cassette rotation shaft $G_A$ is located on the retracted point $P_R$, the cassette A is rotated without causing its leading edge to protrude from the cassette leading edge setting line H.

Figure 44:
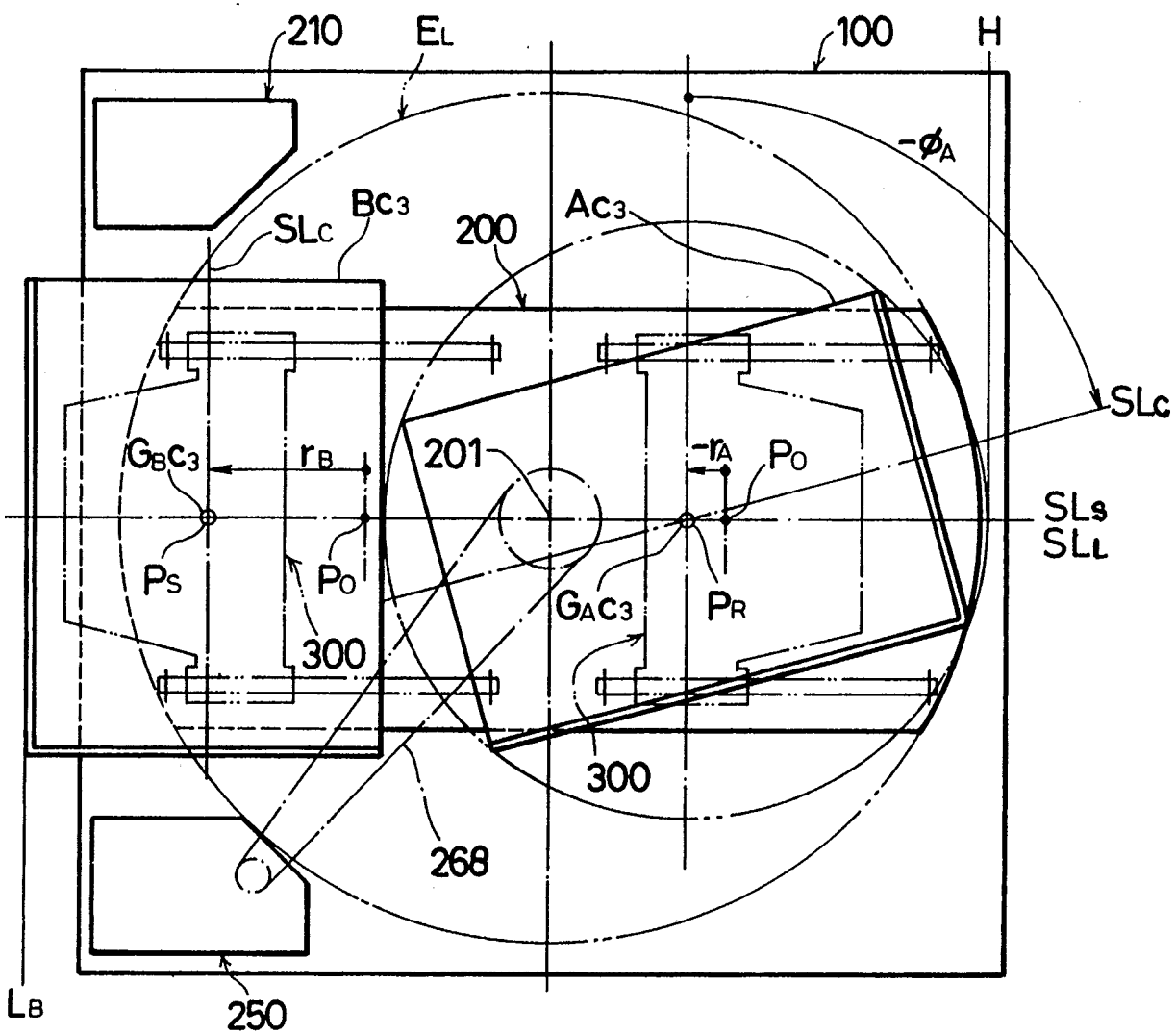
FIG. 44 is an explanatory view illustrating the states of the turntable, carriages and paper cassettes at time $c_3$ during Operation 3 shown in FIGS. 40 and 41.
Figure 45:
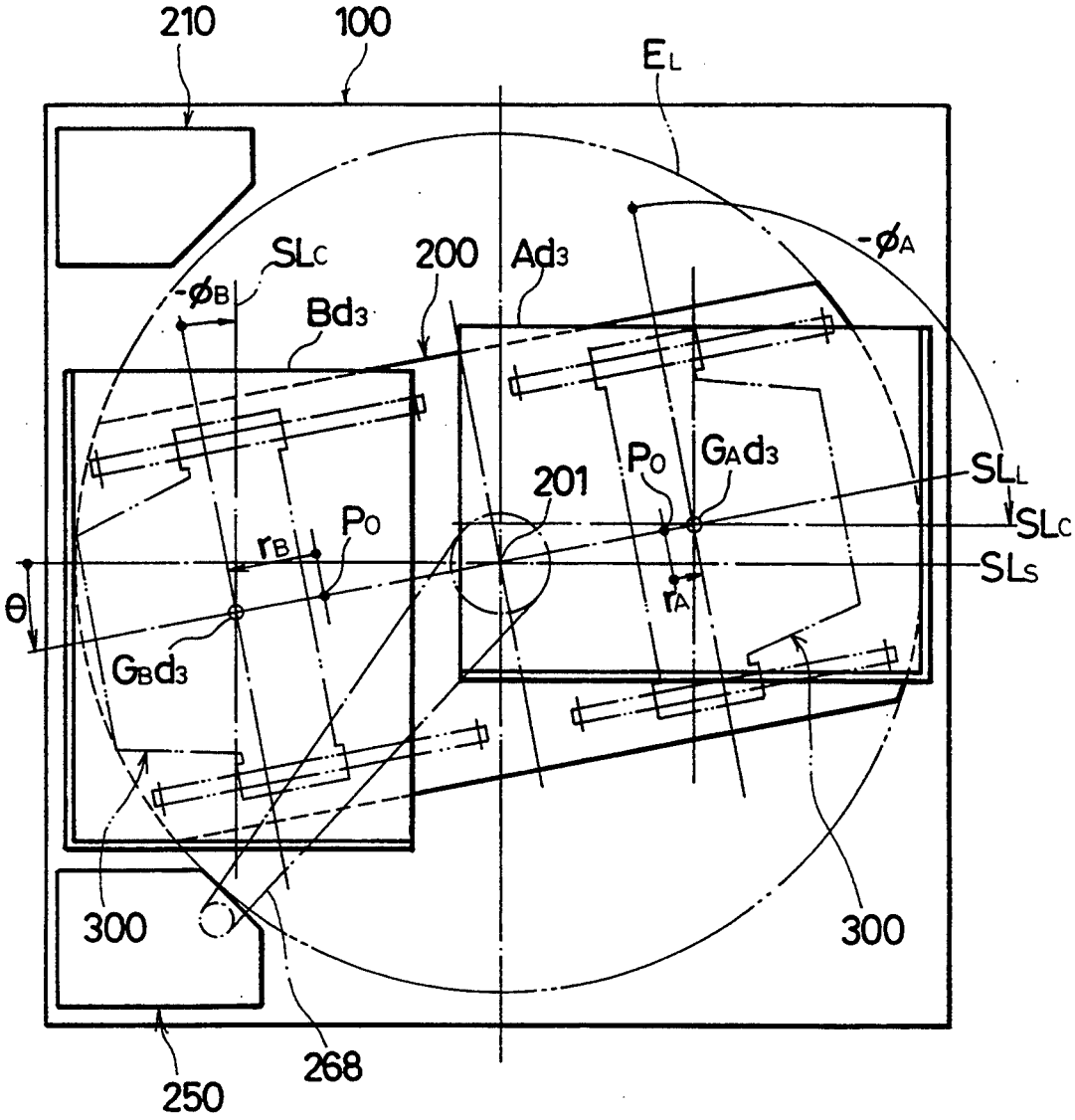
FIG. 45 is an explanatory view illustrating the states of the turntable, carriages and paper cassettes at time $d_3$ during Operation 3 shown in FIGS. 40 and 41.

Regarding the cassette B, as illustrated in FIG. 44, at time $c_3$, the turning angle $\phi_B$ of the cassette rotation shaft $G_B$ is 0°, i.e., it is in a stationary state where its cassette center line $SL_C$ crosses the turntable center line $SL_L$ at right angles and the cassette rotation shaft $G_B$ is stopped at the clearance point $P_S$. The states of the cassette B at time $c_3$ shown in FIG. 44 and time $d_3$ shown in FIG. 45 are the same as those at time $c_1$ and time $d_1$ in Operation 1 shown in FIGS. 33 and 34.

The explanations of Operations 1 to 3 described above show the controlled variable for the case where the cassette A stores B5-sized paper. So, when the cassette A stores paper of a different size, the control variable will vary.

Figure 46:
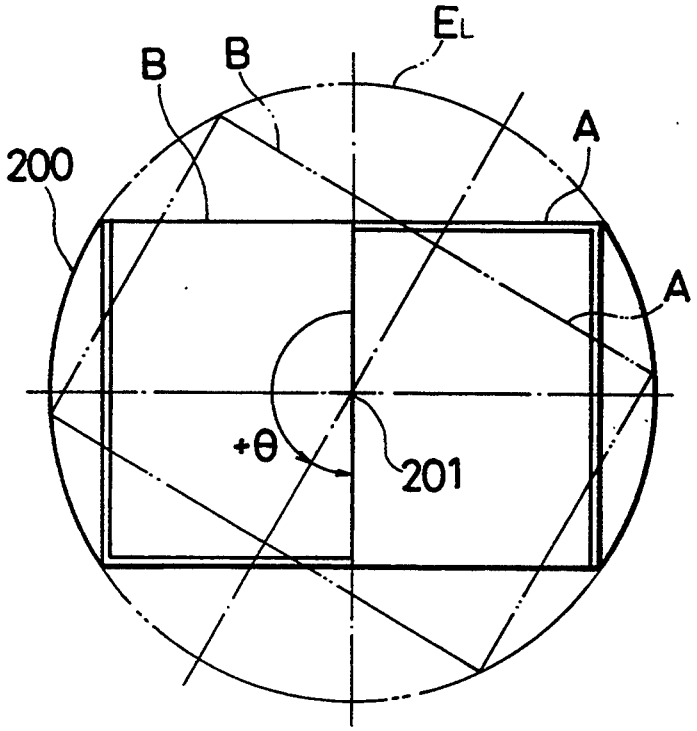
FIG. 46 is a view explaining the rotation of the turntable according to Operation 4 shown in FIG. 23.
Figure 47:
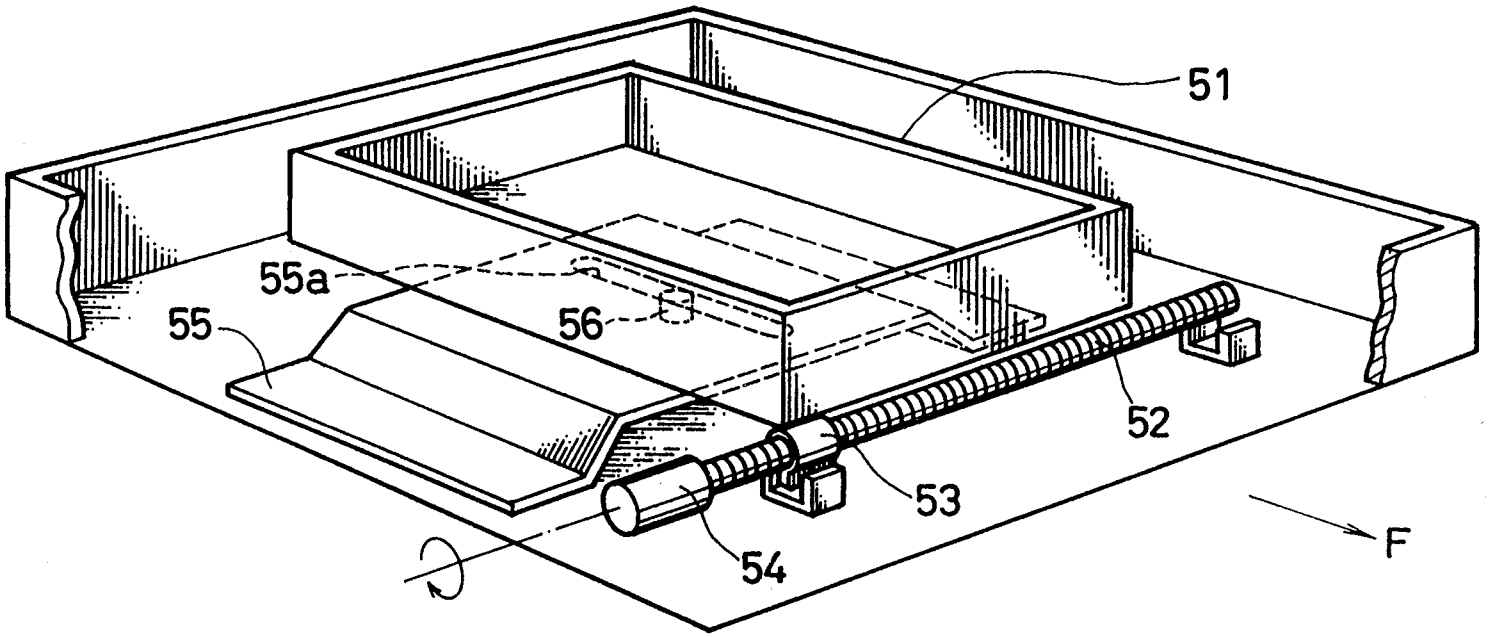
FIG. 47 is a schematic perspective view illustrating a conventional feeding apparatus.

As illustrated in FIG. 46, Operation 4 interchanges the paper cassettes 400 on the feeding side and on the non-feeding side by rotating the turntable 200 by 180 degrees. The two paper cassettes 400 are placed side by side in the closest proximity of the rotation shaft 201, and then the turntable 200 is turned. At this time, the cassette rotation shafts 416 are located on the respective interchanging points $P_O$. Differently from other operations, Operation 4 is performed independently of the $\theta$-axis driving, $\phi$-axis driving and r-axis driving.

As described above, in the rotatable cassette units 4 and 5 of this embodiment, the carriage driving mechanisms 310 and cassette rotating mechanisms 410 are substantially installed within spaces between the respective paper cassettes 400 and the turntable 200. Therefore, in terms of area, only an area occupied by the paper cassettes 400 is required. Namely, there is no need to increase the area particularly for the carriage driving mechanisms 310 and cassette rotating mechanisms 410. Thus, it is possible to reduce the sizes of the rotatable cassettes units 4 and 5.

Moreover, since the 180-degree rotating mechanism 210 and the small angle rotating mechanism 250 are installed under the turntable 200, even if a single carriage driving mechanism 310 and a single cassette rotating mechanism 410 are provided for each paper cassette 400, they will never interfere with the operations of the 180-degree rotating mechanism 210 and the small angle rotating mechanism 250. Accordingly, it is possible to maximize the rotatable cassette-type feeding apparatus's functions.

Additionally, within the rotatable cassette units 4 and 5, the position of the paper in the paper cassette 400 on the feeding side 11 is switched between sideways feed and lengthways feed by rotating the paper cassette 400 on the feeding side 11. Besides, the leading edge of the paper cassette 400 on the feeding side 11 is aligned with the cassette leading edge setting line H by moving the paper cassette 400. Namely, this movement enables the paper cassette 400 to be placed in a predetermined feeding position.

Moreover, by the rotation of the turntable 200 driven by the small angle rotating mechanism 250 and the rotation of the paper cassette 400 in accordance with the rotation of the turntable 200, the paper center Sp of the paper in the paper cassette 400 on the feeding side 11 is aligned with the feeding center line $SL_S$ and the leading edge of the paper is positioned at right angles to the feeding direction.

Further, positioning of the paper in the paper cassette 400 in the predetermined feeding position and aligning of the paper center $S_S$ with the feeding center line $SL_S$ are controlled depending on the size of paper selected without making any changes in the mechanisms. More specifically, the travel distance of the paper Cassette 400 moved by the pulse motor 311 of the carriage driving mechanism 310 and the degree of rotation of the turntable 200 driven by the pulse motor 258 of the small angle rotating mechanism 250 are easily controlled according to a change in the size of the paper.

Furthermore, when switching the position of the paper cassette 400 on the feeding side 11 between sideways feed and lengthways feed, the paper cassette 400 is retracted by the carriage driving mechanism 310 for preventing its leading edge from protruding from the cassette leading edge setting line H toward the feeding direction. This arrangement enables a paper feeding mechanism to be installed in the proximity of the leading edge.

As illustrated in FIGS. 25, 26, 35, 36, 40 and 41, the cassette rotating mechanism 410, the carriage rotating mechanism 310 and the small angle rotating mechanism 250 are simultaneously controlled such that rotation of the paper cassette 400 on the feeding side 11 driven by the cassette rotating mechanism 410, movement of the same paper cassette 400 driven by the carriage rotating mechanism 310 and rotation of the turntable 200 driven by the small angle rotating mechanism 250 are finished within the same period of time. This achieves a shortening of the operation time.

In order to shorten the operation time, the cassette rotating mechanism 410 and the carriage driving mechanism 310 may also be simultaneously controlled such that the rotating operation of the cassette rotating mechanism 410 and the moving operation of the cassette carriage mechanism 310 are finished within the same period of time. In the case when the simplification of control must take precedence over the shortening of the operation time, it may be controlled such that the above-mentioned operations are performed one after another.

In the mean time, it is possible to exclude the small angle rotating mechanism 250 and control thereof in the following situation: the paper is stored in the paper cassette 400 while aligning its paper center $S_P$ with the cassette rotation shaft 416; an apparatus for aligning the paper center $S_P$ with the feeding center line $SL_S$ is provided separately, or feeding of paper is possible without aligning the paper center $S_P$ with the feeding center line $SL_S$. And, in the case when interchanging of the paper cassettes 400 on the feeding side 11 and on the non-feeding side is unnecessary, it is possible to exclude the 180-degree rotating mechanism 210, control thereof, and the turntable 200. In this case, the paper cassettes 400 are installed directly and rotatably on the tray 100, and carriage driving mechanism 310 and the cassette rotating mechanism 410 are mounted on the tray 100.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotatable cassette-type feeding apparatus, comprising:

base means for carrying said rotatable cassette-type feeding apparatus;

storing means for storing copy material on which an image on a document is to be copied and for feeding the copy material from a predetermined feeding position;

carrying means installed on said base means for carrying said storing means, said storing means being rotatable and movable forward and backward in a first direction on said carrying means, and wherein the first direction is a radial direction of rotation of said carrying means;

first rotation driving means installed between said base means and said carrying means for rotating said carrying means;

second rotation driving means installed between said storing means and said carrying means for rotating said storing means;

moving means installed between said storing means and said carrying means for moving said storing means in the first direction, said moving means being level with said second rotation driving means;

first rotation controlling means which controls said first rotation driving means to align the center of the copy material with a transport center line when the copy material is fed;

second rotation controlling means which controls said second rotation driving means to switch a position of the copy material with respect to a second direction in which the copy material is fed and to position a leading edge of the copy material fed from said storing means at right angles to the second direction;

movement controlling means which controls said moving means to move said storing means to the feeding position; and wherein said second rotation driving means is mounted on said moving means and is moved in the first direction together with said storing means.

2. A rotatable cassette-type feeding apparatus, comprising:

base means for carrying said rotatable cassette-type feeding apparatus;

storing means for storing copy material on which an image on a document is to be copied and for feeding the copy material from a predetermined feeding position;

carrying means installed on said base means for carrying said storing means, said storing means being rotatable and movable forward and backward in a first direction on said carrying means, and wherein the first direction is a radial direction of rotation of said carrying means;

first rotation driving means installed between said base means and said carrying means for rotating said carrying means;

second rotation driving means installed between said storing means and said carrying means for rotating said storing means;

moving means installed between said storing means and said carrying means for moving said storing means in the first direction, said moving means being level with said second rotation driving means;

first rotation controlling means which controls said first rotation driving means to align the center of the copy material with a transport center line when the copy material is fed;

second rotation controlling means which controls said second rotation driving means to switch a position of the copy material with respect to a second direction in which the copy material is fed and to position a leading edge of the copy material fed from said storing means at right angles to the second direction;

movement controlling means which controls said moving means to move said storing means to the feeding position;

wherein said moving means includes;

driving means for generating a driving force for moving said storing means;

transmitting means for transmitting the driving force to said storing means; and guiding means which guides said storing means to be moved in the first direction.

3. The rotatable cassette-type feeding apparatus according to claim 2, wherein said driving means is a motor, and said transmitting means includes converter means for converting a rotation of said motor into a horizontal movement in the first direction.

4. The rotatable cassette-type feeding apparatus according to claim 3, wherein said transmission means includes:

a series of gears for transmitting the rotation of said motor;

a pulley to which the rotation is transmitted through said gears; and a wire which is wound around said pulley and installed parallel with said guiding means, both ends of said wire being fastened.

5. The rotatable cassette-type feeding apparatus according to claim 2, wherein said guiding means is guide bars installed parallel with each other with said rotation shaft of said carrying means between them.

6. A rotatable cassette-type feeding apparatus, comprising:

base means for carrying said rotatable cassette-type feeding apparatus;

storing means for storing copy material on which an image on a document is to be copied and for feeding the copy material from a predetermined feeding position;

carrying means installed on aid base means for carrying said storing means, said storing means being rotatable and movable forward and backward in a first direction on said carrying means, and wherein the first direction is a radial direction of rotation of said carrying means;

first rotation driving means installed between said base means and said carrying means for rotating said carrying means;

second rotation driving means installed between said storing means and said carrying means for rotating said storing means;

moving means installed between said storing means and said carrying means for moving said storing means in the first direction, said moving means being level with said second rotation driving means;

first rotation controlling means which controls said first rotation driving means to align the center of the copy material with a transport center line when the copy material is fed;

second rotation controlling means which controls said second rotation driving means to switch a position of the copy material with respect to a second direction in which the copy material is fed and to position a leading edge of the copy material fed from said storing means at right angles to the second direction;

movement controlling means which controls said moving means to move said storing means to the feeding position;

wherein said moving means includes a moving plate for carrying said storing means, and wherein said second rotation driving means includes;

turning force generating means for generating a driving force for rotating said storing means;

a rotation shaft which passes through said moving plate and is mounted on the bottom surface of said storing means; and rotation transmitting means for transmitting the driving force to said rotation shaft.

7. The rotatable cassette-type feeding apparatus according to claim 6, wherein said moving means further comprising driving means for producing a driving force for moving said storing means in the first direction, said turning force generating means and said driving means being installed on a face of said moving plate so as to be level with each other.

* * * * *